US009364066B2

(12) United States Patent
Moore

(10) Patent No.: US 9,364,066 B2
(45) Date of Patent: Jun. 14, 2016

(54) METHOD FOR CUTTING HAIR

(71) Applicant: Diana Kim Moore, Mount Olive, NC (US)

(72) Inventor: Diana Kim Moore, Mount Olive, NC (US)

( * ) Notice: Subject to any disclaimer, the term of this patent is extended or adjusted under 35 U.S.C. 154(b) by 0 days.

(21) Appl. No.: 14/474,080

(22) Filed: Aug. 29, 2014

(65) Prior Publication Data

US 2015/0059543 A1 Mar. 5, 2015

Related U.S. Application Data

(60) Provisional application No. 61/871,737, filed on Aug. 29, 2013.

(51) Int. Cl.
*A45D 7/00* (2006.01)

(52) U.S. Cl.
CPC ..... *A45D 7/00* (2013.01); *A45D 2007/007* (2013.01); *Y10T 83/0524* (2015.04)

(58) Field of Classification Search
CPC ..... A45D 7/00; A45D 2007/007
See application file for complete search history.

(56) References Cited

U.S. PATENT DOCUMENTS

| | | | |
|---|---|---|---|
| 2,070,356 | A | 2/1937 | Christy |
| 2,789,566 | A | 4/1957 | Garoutte |
| 2,919,702 | A | 1/1960 | Olivo |
| 3,223,092 | A | 12/1965 | Marsico |
| 5,832,937 | A | 11/1998 | Fujikawa |
| 8,262,392 | B2 | 9/2012 | Kubo |
| 8,397,734 | B2 | 3/2013 | Mennella |
| 2008/0060666 | A1 | 3/2008 | Bandonis |

OTHER PUBLICATIONS

Milady's Standard Cosmetology. Dawn Gerrain 2008.*

* cited by examiner

*Primary Examiner* — Rachel Steitz
(74) *Attorney, Agent, or Firm* — Memminger E. Wiggins

(57) ABSTRACT

The present invention is directed to a method for cutting hair that incorporates the shape of the head to determine the angles at which the hair will be cut for a given hair style. The angle at which the hair is cut depends on the shape of the head where the cut is made as well as the angle at which the hair falls at the cut. The shape of the head changes according to location, and therefore the angle at which the hair is cut changes accordingly. Other factors also taken into consideration by the present invention include the natural fall of the hair, the density of the hair, and the guide lengths and the perimeter lines of the haircut style.

13 Claims, 27 Drawing Sheets

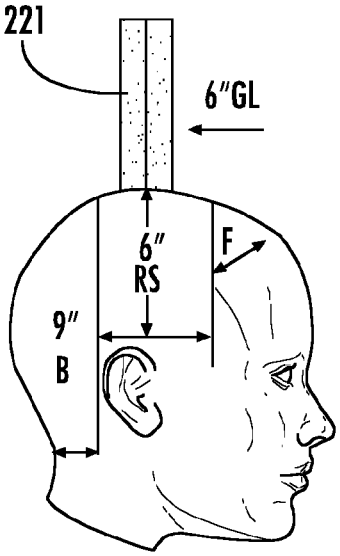
FIG. 22A
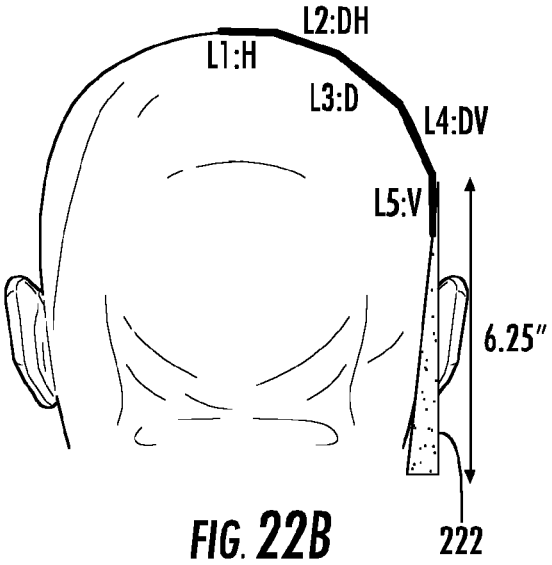
FIG. 22B
FORMULATION SHEET
| | |
|---|---|
| · QUADRANT | RIGHT SIDE QUADRANT |
| · GUIDE LENGTH IN INCHES | 6" |
| · TOP OF PERIMETER LENGTH IN INCHES | 6.25" |
| · AMOUNT OF INCHES NEEDED TO + OR - | +.25" |
| · AMOUNT OF SCALP TO WORK WITH IN INCHES | 6" - 2" = 4" |
FIG. 22C

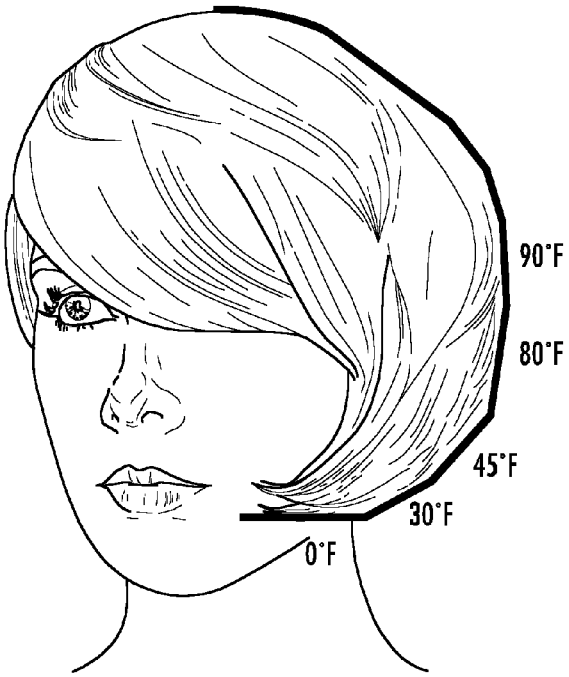
FIG. 23A
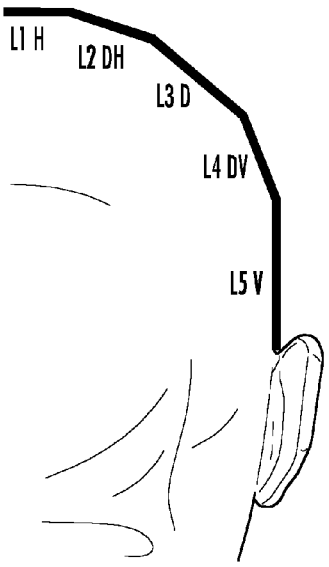
FIG. 23B
FORMULATION SHEET
- QUADRANT RIGHT SIDE QUADRANT
- GUIDE LENGTH IN INCHES 6″
- TOP OF PERIMETER LENGTH IN INCHES 6.25″
- AMOUNT OF INCHES NEEDED TO + OR - +.25″
- AMOUNT OF SCALP TO WORK WITH IN INCHES 6″ - 2″ = 4″
LEVEL/HS/GL +PROJECTION ANGLE = FALL ANGLE
| | | | |
|---|---|---|---|
| L1 (H + 6″ GL) | + | | =90 F |
| L2 (DH + | + | | =80 F |
| L3 (D + | + | | =45 F |
| L4 (DV + | + | | =30 F |
| L5A (V + 6.25 GL) | + | | =0 F |
| L5B (V + __GL) | + | | =0 F |
PERIMETER LENGTH = APPROX. 6.25″
FIG. 23C

| | H | | | | | DH | | | | | D | | | | | DV | | | | | V | | | | |
|---|---|---|---|---|---|---|---|---|---|---|---|---|---|---|---|---|---|---|---|---|---|---|---|---|---|
| | 2″ | 3″ | 4″ | 5″ | 6″ | 2″ | 3″ | 4″ | 5″ | 6″ | 2″ | 3″ | 4″ | 5″ | 6″ | 2″ | 3″ | 4″ | 5″ | 6″ | 2″ | 3″ | 4″ | 5″ | 6″ |
| 180F | 115 | 135+ | x | | | 135+ | x | | | | | | | | | | | | | | | | | | |
| 175-160F | 90 | 110 | 130+ | x | | 110 | 130+ | x | | | 135+ | x | | | | | | | | | | | | | |
| 155-140F | 75 | 90 | 110 | 135+ | x | 95 | 115 | 130+ | x | | 115 | 130+ | x | | | 135+ | x | | | | | | | | |
| 135-120F | 65 | 80 | 105 | 130+ | x | 90 | 105 | 120 | 135+ | x | 105 | 120 | 130 | 140+ | x | 115 | 125 | 135+ | x | | | | | | |
| 115-95F | 60 | 70 | 100 | 120 | 140+ | 80 | 95 | 110 | 125 | 140+ | 100 | 110 | 120 | 130 | 140+ | 105 | 115 | 125 | 135+ | x | 135+ | x | | | |
| 90F | x | 60 | 95 | 110 | 135+ | 75 | 90 | 105 | 120 | 135+ | 90 | 100 | 115 | 125 | 135+ | 100 | 110 | 120 | 130 | 135+ | 125 | 130 | 135+ | 135+ | 135+ |
| 85-75F | x | 40 | 65 | 90 | 110 | 40 | 55 | 70 | 95 | 110 | 70 | 80 | 90 | 100 | 110 | 75 | 85 | 95 | 105 | 110 | 100 | 105 | 110 | 110 | 110 |
| 70-60F | x | 30 | 50 | 70 | 90 | 30 | 45 | 60 | 75 | 90 | 50 | 60 | 70 | 80 | 90 | 55 | 65 | 75 | 85 | 90 | 80 | 85 | 90 | 90 | 90 |
| 55-45F | x | 15 | 30 | 50 | 70 | 10 | 25 | 40 | 55 | 70 | 30 | 40 | 50 | 60 | 70 | 40 | 50 | 60 | 65 | 70 | 60 | 65 | 70 | 70 | 70 |
| 40-30F | x | 0 | 20 | 40 | 60 | 0 | 15 | 30 | 45 | 60 | 20 | 30 | 40 | 50 | 60 | 35 | 40 | 45 | 55 | 60 | 50 | 55 | 60 | 60 | 60 |

FIG. 24A

INCREASE OR DECREASE IN LENGTH BY CUTTING ANGLE PER 1″ OF SCALP VERTICALLY

| | |
|---|---|
| ◦ 180 | +1″ |
| ◦ 135 | +.75″ |
| ◦ 120 | +.50″ |
| ◦ 105 | +.25″ |
| ◦ 90 | 0 |
| ◦ 75 | -.25″ |
| ◦ 60 | -.50″ |
| ◦ 45 | -.75″ |
| ◦ 0 | -1″ |

FIG. 24B

| | H | | | | | DH | | | | | D | | | | | DV | | | | | V | | | | |
|---|---|---|---|---|---|---|---|---|---|---|---|---|---|---|---|---|---|---|---|---|---|---|---|---|---|
| | 2″ | 3″ | 4″ | 5″ | 6″ | 2″ | 3″ | 4″ | 5″ | 6″ | 2″ | 3″ | 4″ | 5″ | 6″ | 2″ | 3″ | 4″ | 5″ | 6″ | 2″ | 3″ | 4″ | 5″ | 6″ |
| 180F | 115 | 135+ | x | | | 135+ | x | | | | | | | | | | | | | | | | | | |
| 175-160F | 90 | 110 | 130+ | x | | 110 | 130+ | x | | | 135+ | x | | | | | | | | | | | | | |
| 155-140F | 75 | 90 | 110 | 135+ | x | 95 | 115 | 130+ | x | | 115 | 130+ | x | | | 135+ | x | | | | | | | | |
| 135-120F | 65 | 80 | 105 | 130+ | x | 90 | 105 | 120 | 135+ | x | 105 | 120 | 130 | 140+ | x | 115 | 125 | 135+ | x | | | | | | |
| 115-95F | 60 | 70 | 100 | 120 | 140+ | 80 | 95 | 110 | 125 | 140+ | 100 | 110 | 120 | 130 | 140+ | 105 | 115 | 125 | 135+ | x | 135+ | x | | | |
| 90F | x | 60 | 95 | 110 | 135+ | 75 | 90 | 105 | 120 | 135+ | 90 | 100 | 115 | 125 | 135+ | 100 | 110 | 120 | 130 | 135+ | 125 | 130 | 135+ | 135+ | 135+ |
| 85-75F | x | 40 | 65 | 90 | 110 | 40 | 55 | 70 | 95 | 110 | 70 | 80 | 90 | 100 | 110 | 75 | 85 | 95 | 105 | 110 | 100 | 105 | 110 | 110 | 110 |
| 70-60F | x | 30 | 50 | 70 | 90 | 30 | 45 | 60 | 75 | 90 | 50 | 60 | 70 | 80 | 90 | 55 | 65 | 75 | 85 | 90 | 80 | 85 | 90 | 90 | 90 |
| 55-45F | x | 15 | 30 | 50 | 70 | 10 | 25 | 40 | 55 | 70 | 30 | 40 | 50 | 60 | 70 | 40 | 50 | 60 | 65 | 70 | 60 | 65 | 70 | 70 | 70 |
| 40-30F | x | 0 | 20 | 40 | 60 | 0 | 15 | 30 | 45 | 60 | 20 | 30 | 40 | 50 | 60 | 35 | 40 | 45 | 55 | 60 | 50 | 55 | 60 | 60 | 60 |

HEAD SHAPE

GUIDE LENGTHS

BLANK SPACES

PROJECTION ANGLES

FALL ANGLES

FIG. 25

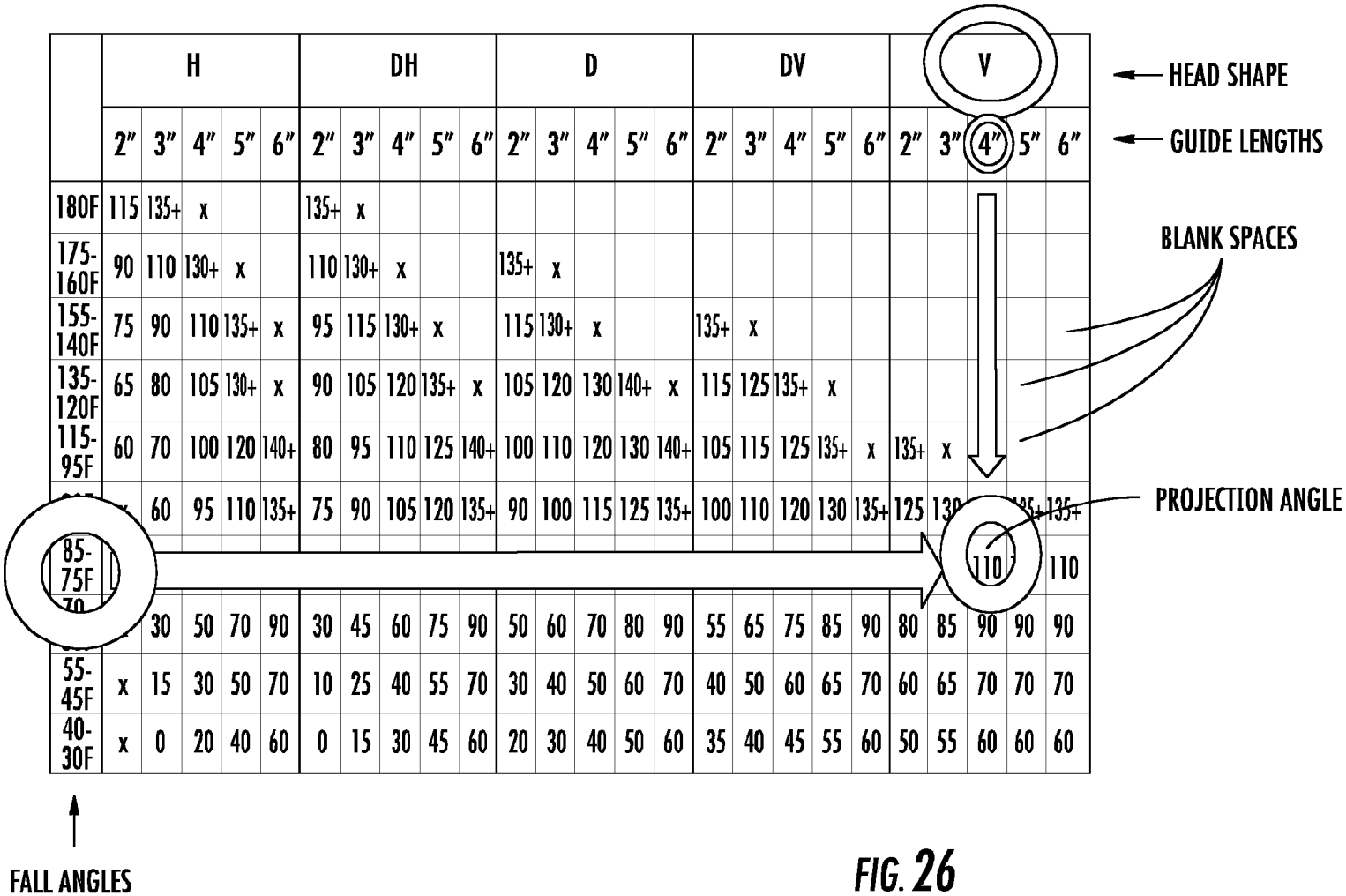
HEAD SHAPE
GUIDE LENGTHS
BLANK SPACES
PROJECTION ANGLE
FALL ANGLES
V
DV
D
DH
H
2" 3" 4" 5" 6"
180F 115 135+ x
175-160F 90 110 130+ x
155-140F 75 90 110 135+ x
135-120F 65 80 105 130+ x
115-95F 60 70 100 120 140+
135+ x
110 130+ x
95 115 130+ x
90 105 120 135+ x
80 95 110 125 140+
135+ x
135+ x
115 130+ x
105 120 130 140+ x
100 110 120 130 140+
135+ x
135+ x
115 125 135+ x
105 115 125 135+ x
135+ x
135+ x
125 135+
100 110 120 130 135+
90 100 115 125 135+
75 90 105 120 135+
60 95 110 135+
135+ 125 130
110
85-75F
55-45F 10 25 40 55 70 30 40 50 60 70 35 40 45 55 60
40-30F 0 15 30 45 60 20 30 40 50 60 35 40 45 55 60
30 45 60 75 90 50 60 70 80 90 55 65 75 85 90
30 50 70 90 80 85 90 90
55 65 75 85 90
55 60 70 80 90
50 60 70 80 90
50 60 70 80 90
55 60 70 80 90
55 60 70 80 90
55

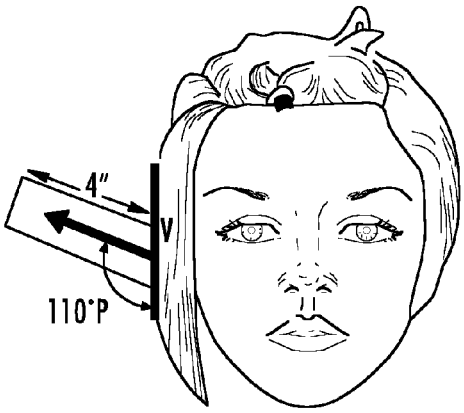
FIG. 27A
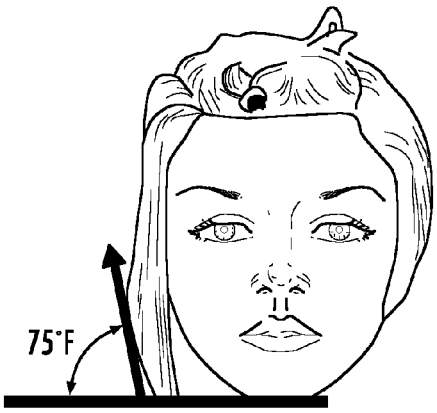
FIG. 27B
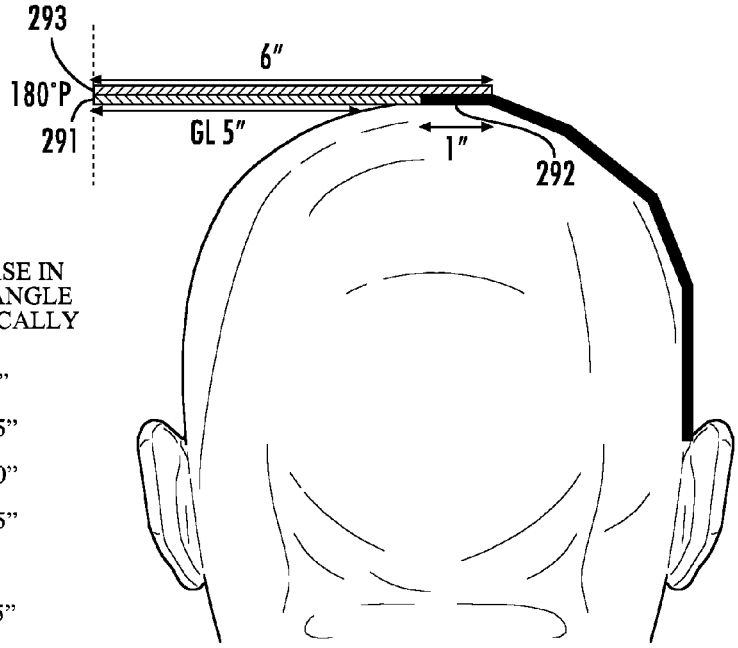
FIG. 29
INCREASE OR DECREASE IN LENGTH BY CUTTING ANGLE PER 1" OF SCALP VERTICALLY
| | |
|---|---|
| 180 | +1" |
| 135 | +.75" |
| 120 | +.50" |
| 105 | +.25" |
| 90 | 0 |
| 75 | -.25" |
| 60 | -.50" |
| 45 | -.75" |
| 0 | -1" |
FIG. 28

| | L1 H | | | | | L2 DH | | | | | L3 D | | | | | L4 DV | | | | | L5&6 V | | | | |
|---|---|---|---|---|---|---|---|---|---|---|---|---|---|---|---|---|---|---|---|---|---|---|---|---|---|
| | 2" | 3" | 4" | 5" | 6" | 2" | 3" | 4" | 5" | 6" | 2" | 3" | 4" | 5" | 6" | 2" | 3" | 4" | 5" | 6" | 2" | 3" | 4" | 5" | 6" |
| 180F | 115 | 135+ | x | | | 135+ | x | | | | | | | | | | | | | | | | | | |
| 175-160F | 90 | 110 | 130+ | x | | 110 | 130+ | x | | | 135+ | x | | | | | | | | | | | | | |
| 155-140F | 75 | 90 | 110 | 135+ | | 95 | 115 | 130+ | x | | 115 | 130+ | x | | | 135+ | x | | | | | | | | |
| 135-120F | 65 | 80 | 105 | 130+ | | 90 | 105 | 120 | 135+ | | 105 | 120 | 130 | 140+ | | 115 | 125 | 135+ | x | | | | | | |
| 115-95F | 60 | 70 | 100 | 120 | | 80 | 95 | 110 | 125 | | 100 | 110 | 120 | 130 | | 105 | 115 | 125 | 135+ | | 135+ | x | | | |
| 90F | | | | | 135+ | 75 | 90 | 105 | 120 | | 95 | 100 | 115 | 125 | | 100 | 110 | 120 | 130 | | 125 | 130 | 135+ | 135+ | 135+ |
| 85-75F | | | | | | | | | | 110 | 70 | 80 | 90 | 100 | | 75 | 85 | 95 | 105 | | 100 | 105 | 110 | 110 | 110 |
| 70-60F | x | 30 | 50 | 70 | 90 | 30 | 45 | 60 | 75 | 90 | 50 | 60 | 70 | 80 | | 55 | 65 | 75 | 85 | | 80 | 85 | 90 | 90 | 90 |
| 55-45F | | | | | | | | | | | | | | | 70 | 40 | 50 | 60 | 65 | | 60 | 65 | 70 | 70 | 70 |
| 40-30F | | | | | | | | | | | | | | | | | | | | 60 | 50 | 55 | 60 | 60 | 60 |

FIG. 30

FORMULATION SHEET

- QUADRANT RIGHT SIDE QUADRANT
- GUIDE LENGTH IN INCHES 6"
- TOP OF PERIMETER LENGTH IN INCHES 6.25"
- AMOUNT OF INCHES NEEDED TO + OR - +.25"
- AMOUNT OF SCALP TO WORK WITH IN INCHES 6" - 2" = 4"

LEVEL/HS/GL +PROJECTION ANGLE = FALL ANGLE

| | | | |
|---|---|---|---|
| L1 (H + 6" GL) | + | (135 P) | =90 F |
| L2 (DH + 6.75"GL) | + | (110 P) | =80 F |
| L3 (D + 7"GL) | + | (70 P) | =45 F |
| L4 (DV + 6.75GL | + | (60 P) | =30 F |
| L5A (V + 6.25 GL) | + | (0 P) | =0 F |
| L5B (V + __GL) | + | (0 P) | =0 F |

PERIMETER LENGTH = APPROX. 6.25"

FIG. 31

FORMULATION SHEET

. QUADRANT RIGHT SIDE QUADRANT

. GUIDE LENGTH IN INCHES 6"

. TOP OF PERIMETER LENGTH IN INCHES 6.25"

. AMOUNT OF INCHES NEEDED TO + OR - +.25"

. AMOUNT OF SCALP TO WORK WITH IN INCHES 6"- 2"= 4"

LEVEL/HS/GL +PROJECTION ANGLE = FALL ANGLE

| | | | |
|---|---|---|---|
| L1 (H + 6" GL) | + | (135 P) | =90 F |
| L2 (DH + 6.75"GL) | + | (110 P) | =80 F |
| L3 (D + 7"GL) | + | (70 P) | =45 F |
| L4 (DV + 6.75GL) | + | (60 P) | =30 F |
| L5A (V + 6.25 GL) | + | (0 P) | =0 F |
| L5B (V + __GL) | + | (0 P) | =0 F |

PERIMETER LENGTH = APPROX. 6.25"

METHOD FOR CUTTING HAIR

FIELD OF THE INVENTION

The present invention relates to a method for cutting hair which utilizes a formulation sheet and a projection chart to customize the style of the desired haircut to the unique shape of an individual's head. The formulation sheet and projection chart incorporate such factors as the shape of a person's head, the fall of the person's hair, and an angle of projection by which the hair is cut.

BACKGROUND OF THE INVENTION

While the styles of haircuts are numerous and are constantly changing, the fundamentals for cutting hair to achieve a particular style has remained unchanged for the most the part. Traditional methods of cutting hair include such factors as the area of the head where the cut will be made, the location of hairlines, the length of the hair for the style, the texture of the hair, the curl of the hair, the growth pattern of the hair, the thickness or density of the hair, the shape of a person's face relative to the shape of the style of haircut, and the angle at which the hair is cut relative to the desired style. Some methods for cutting hair may employ the actual removal of sections of hair to effect a particular haircut style. This is accomplished by cutting the hair in such a manner that it causes the hair to bend at predetermined points by causing the strands of hair to become oval at the points of bending which forms a wave in the surface of the hair.

Additionally, other methods of cutting hair may identify regions and areas of the head and lengths of the hair with respect to cutting the hair, but these cuts are without consideration of the angle of the head shape at the location of the cut. Traditionally, the angle at which hair is cut is one in which the angle is determined relative to the floor. As such, 0 degrees would be cut in a horizontal line parallel to the floor; 180 degrees would be cut in a horizontal line parallel to the floor with the hair being pulled straight up towards the ceiling; and 90 degrees being pulled out from the head and held in a straight line between the floor and the ceiling, parallel to both and cut vertically, perpendicular to both.

Accordingly, there remains room for improvement and variation within the art.

SUMMARY OF THE INVENTION

Various features and advantages of the invention will be set forth in part in the following description, or may be obvious from the description, or may be learned from practice of the invention.

The present invention relates to a method for cutting hair which incorporates the unique shape of a person's head. The angle at which the hair is cut depends on the shape of the head where the cut is made as well as the angle at which the hair falls at the cut. The shape of the head changes according to location, and therefore the angle at which the hair is cut changes. The method divides a person's scalp into distinct areas identified as quadrants and sub-quadrants. The quadrants and sub-quadrants are further divided into planes based on the changes in slope within each quadrant and sub-quadrants. The planes in a quadrant exist at a specified level and further characterized by their respective slopes. Other factors also taken into consideration by the present invention include the natural fall of the hair, the density of the hair, and the guide lengths and the perimeter lines of the haircut style.

One aspect of the present invention provides a method for cutting hair that utilizes the slope of various planes located on a person's scalp and the fall of the person's hair. The method includes the steps of a hairstylist evaluating various physical attributes of a client's head and hair in light of the haircut style desired by the client. Another step includes the hairstylist determining the location on the client's scalp for each of a plurality of quadrants with each quadrant comprising a plurality of bead shape categories. The quadrants comprising a front quadrant, a left side quadrant, a right side quadrant, and a back quadrant with the back quadrant being subdivided into a left back quadrant, a center back quadrant, and a right back quadrant. An additional step in the method includes the hairstylist determining and cutting the guide lengths for the haircut shape for each quadrant. The guide length being the top portion of hair running horizontally within the quadrant. The method also includes the step of the hairstylist determining and cutting one or more perimeter lines of the haircut style, where the perimeter line comprises the hair at the bottom of the desired hairstyle for each of the quadrants. Another step in the method includes the hairstylist determining one or more fall angles for the haircut shape of the haircut style desired by the client in which the natural fall of hair is the position in which the hair rests due to gravity. The method also includes the step of the hairstylist determining a plurality of numerically sequential adjoining planes for each of the quadrants on a client's scalp. The hairstylist next determines the projection angle for each of the planes identified on the client's scalp. Finally, the hairstylist uses the projection angle to cut the client's hair on each plane of the client's scalp.

One aspect of the present invention is to provide a method for cutting hair that utilizes a formulation sheet and a projection chart which incorporates such factors as the shape of the head for specific areas, the fall angles of hair for a specific hair style, and the angle at which hair is cut to achieve the desired hair style.

Another aspect of the present invention is to provide a method for cutting hair which will produce consistent results.

Another aspect of the present invention is to provide a method for cutting hair that can be applied to numerous styles of haircuts.

A further aspect of the present invention is to provide a method for cutting hair that produces consistent results regardless of the shape of a person's head.

Another aspect of the present invention is to provide a method for cutting hair can accommodate a variety of hair textures and densities.

A further aspect of the present invention is to provide a method for cutting hair which accurately predicts the final look of a haircut on a person's head through the customization of the haircut for a client.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

FIG. 22*a* is an explanatory view illustrating a 6 inch guide length for the right side quadrant;

FIG. 22*b* is an explanatory view illustrating the length at the top of a perimeter line;

FIG. 22*c* is an explanatory view illustrating a formulation sheet;

FIG. 23*a* is an explanatory view illustrating fall angles;

FIG. 23*b* is an explanatory view illustrating levels and head shape categories of a right side quadrant;

FIG. 23*c* is an explanatory view illustrating a partially complete formulation sheet;

FIG. 24*a* is an explanatory view illustrating of a projection chart;

FIG. 24*b* is an explanatory view illustrating of an increase/decrease table;

FIG. 25 is an explanatory view illustrating components of a projection chart;

FIG. 26 is an explanatory view illustrating the use of a projection chart;

FIG. 27*a* is an explanatory view illustrating hair cut at 110 degree projection;

FIG. 27*b* is an explanatory view illustrating hair falling into a 75 degree fall angle;

FIG. 28 is an explanatory view illustrating an increase/decrease table;

FIG. 29 is an explanatory view illustrating a hair section cut at 180 degrees;

FIG. 30 is an explanatory view illustrating the use of projection of projection chart;

FIG. 31 is an explanatory view illustrating a completed formulation sheet;

DETAILED DESCRIPTION OF THE INVENTION

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, Which broader aspects are embodied in the exemplary constructions.

The present invention describes a method for cutting hair which recognizes the unique shape of an individual's head. The method utilizes a Formulation Sheet to customize the style of a desired haircut in accordance to the client's head shape. The method incorporates various factors to achieve a desired haircut style. Such factors include, but are not limited to, the shape of a person's head, the fall of a person's hair, and an angle of projection by which the person's hair is cut. The following examples and illustrations describe a new method for cutting hair. The primary steps are first, choosing a hairstyle by the client; second, determining the quadrants on the client's scalp; third, determining one or more fall angles for the haircut style; fourth, determining and cutting one or more guide lengths for the haircut for each of the quadrants; fifth, determining and cutting one or more perimeter lines; sixth, determining the types of planes for each of the quadrants; seventh, determining the projection angles, and eighth, cutting the client's hair at each projection angle for each plane of each quadrant.

Figure 1:
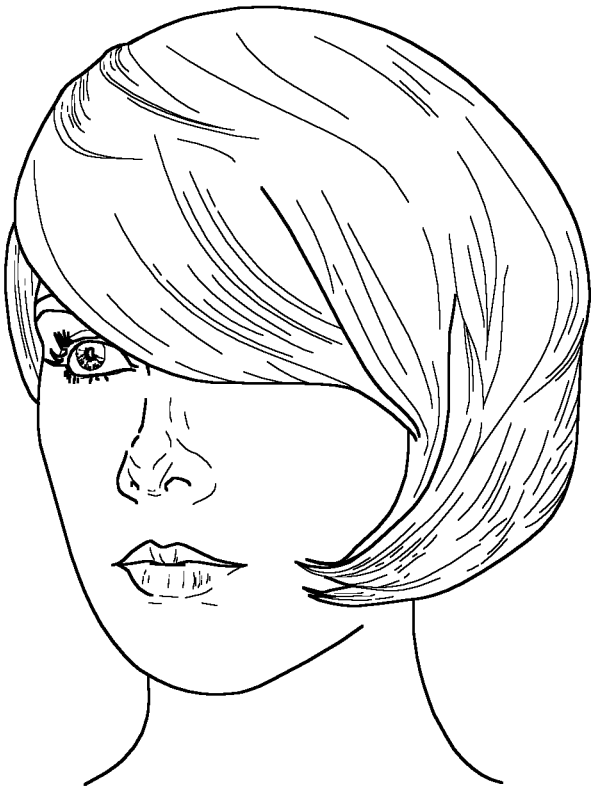
FIG. 1 is a perspective view of a haircut shape.

The first step of the present inventive method occurs with the meeting of the hairstylist and the hairstylist's client. The hairstylist's evaluation of the client includes various factors relating the client's head and hair. Such factors include the overall physical attributes of the client's head such as a top and a crown of the head, including a part located on the top of the client's head; a front side, a left side, a right side, and a back side of the head and the numerous slopes that are present on the sides of the head occurring downward from the top of the client's head; a scalp covering the client's head; a body of hair emanating from the scalp, the hair having numerous densities and volumes about the client's head; a front hairline, a left side hairline, a right side hairline, and aback hairline. With the assistance of the hairstylist and other aids, such as photographs of various hairstyles, the client and hairstylist decide on what haircut shape to pursue for the client, such haircut style having a haircut shape as illustrated in FIG. 1.

Figure 2A:
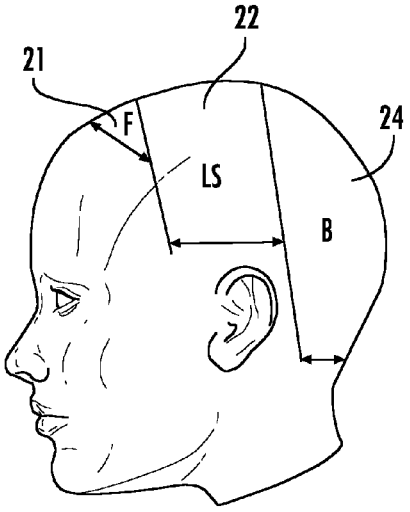
FIG. 2*a* is an explanatory view illustrating hairlines as viewed from the left side.
Figure 2B:
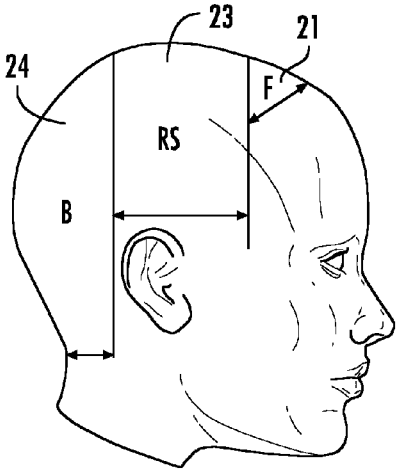
FIG. 2*b* is an explanatory view illustrating hairlines as viewed from the right side.

Once the haircut shape has been determined, the quadrant's on the client's scalp are identified. The location of the quadrants are determined by three factors. The first factor is the location of the client's hairline and those points at which the hairline changes. Now referring to FIGS. 2*a* and 2*b*, there are typically three hairlines, a left side (LS) hairline 22, a right side (RS) hairline 23, and a back (B) hairline 24. The front (F) hairline 21 is traditionally referred to as the "bang" area. Using the present invention the quadrants are identified and separated at those points on a client's head where the hairline changes and are shown in FIGS. 3*a* and 3*b* as a front quadrant (F) 31, a left side quadrant (LS) 32, aright side quadrant (RS) 33, and a back side quadrant.

Figure 3A:
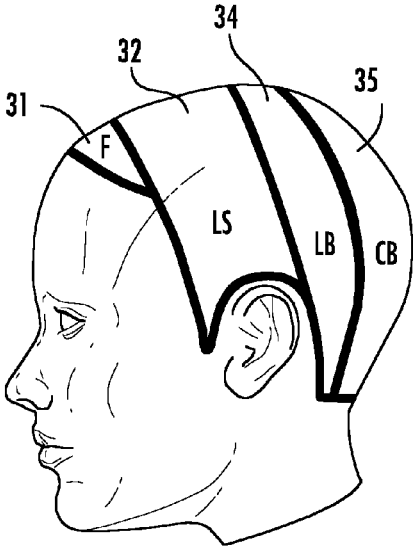
FIG. 3*a* is an explanatory view illustrating quadrants as viewed from the left side.
Figure 3B:
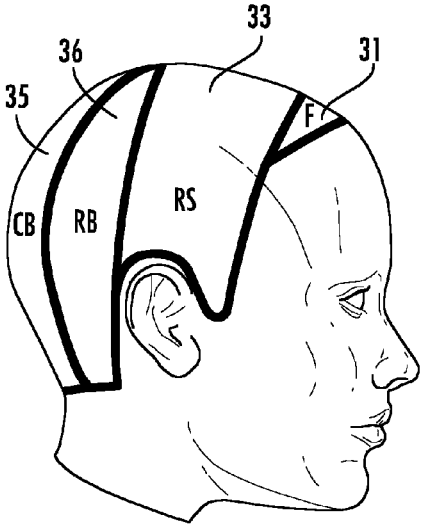
FIG. 3*b* is an explanatory view illustrating quadrants as viewed from the right side.

Continuing to refer to FIGS. 3*a* and 3*b*, the second factor in determining the location of the quadrants is addressed. The back quadrant is subdivided into three sub-quadrants and identified as the left back quadrant (LB) 34, the center back quadrant (CB) 35, and the right back quadrant (RR) 36. To divide the back quadrant into its three sub-quadrants, the backside of a comb is positioned horizontally on the center back (CB) 35 of the head. To find the right back (RB) 36 sub-quadrant the hairstylist presses on the comb to the right horizontally. The comb will then move into a different plane horizontally. Where the comb comes to rest will be the right back (RB) 36 sub-quadrant. Next, the comb is returned to the center back (CB) 35 position, and the hairstylist presses on the left side of the comb to which the comb responds by coming to rest on the next horizontal plane which will be the left back (LB) 34 sub-quadrant.

The third factor which affects quadrant location is related to growth patterns in the hair. If a strong cowlick is present in the crown of the head and that cowlick is pushing hair into an opposite direction, then whichever direction that hair is falling into becomes a part of that quadrant. For example, if a person's hair is growing out of the center back (CB) sub-quadrant, but the cowlick is making that hair grow into the direction of the right back (RB) sub-quadrant, then that hair should be included in the right back (RB) sub-quadrant. Once the widths of the quadrants are determined based on the respective hairline widths, and the back quadrant is subdivided, the front quadrant (F) 31 is extended upward from the front hairline 21 to the top of the head; the left side (LS) quadrant 32 is extended upward from the left side hairline 22 to the top of the head; the right side (RS) quadrant 33 is extended upward from the right side hairline 23 to the top of the head; the back sub-quadrants (LB, CB, RB) 34, 35, 36 are extended upward from the back hairline to the top of the head, such that all of the quadrants converge at the top of the client's head.

Figure 4:
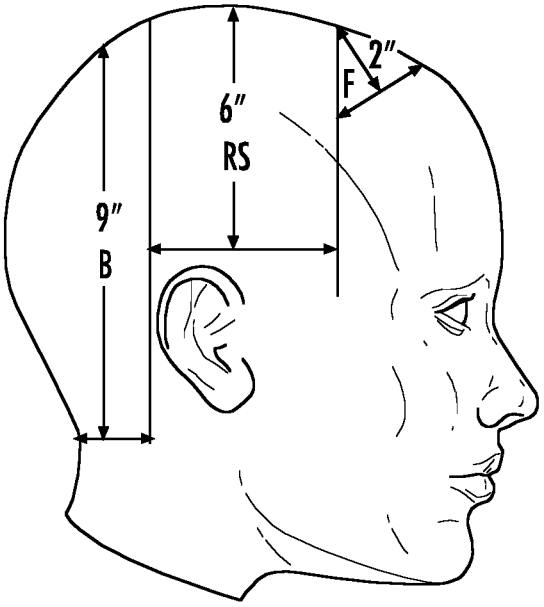
FIG. 4 is an explanatory view illustrating the height of quadrants viewed from the right side.

Referring to FIG. 4, it is necessary to measure the height of each quadrant from the part at the top of the client's head down to the hairline within each quadrant. The total height of a quadrant is measured from the hair line up to the parting. If a client parts their hair on the left side and redirects the hair over so that it falls into the right side, that hair would be included in the total height of the right side quadrant. As such, the height of each quadrant can vary from quadrant to quadrant based on the location of each hairline, the growth patterns of the hair, and the styling of the hair. It is important to know how many inches of scalp the hairstylist has to work within because that will help determine how much shape she can or cannot build within that quadrant. Once the hairstylist has measured the height of each quadrant, it should be recorded into the Formulation Sheet.

The next step of the present invention is determining and cutting one or more guide lengths for the chosen haircut shape. One or more guide lengths exist in each of the quadrants located on the client's head. A guide length can be generally thought of as that top portion of hair within each of the quadrants which runs horizontally within that quadrant which it is found. In determining a guide length the photograph of the haircut shape of the client's chosen haircut style is evaluated to locate where the subject top portion of hair exists. A guide length can be thought of as a roof of a house, because it is the very top portion of hair that runs horizontally within any quadrant.

Figure 5:
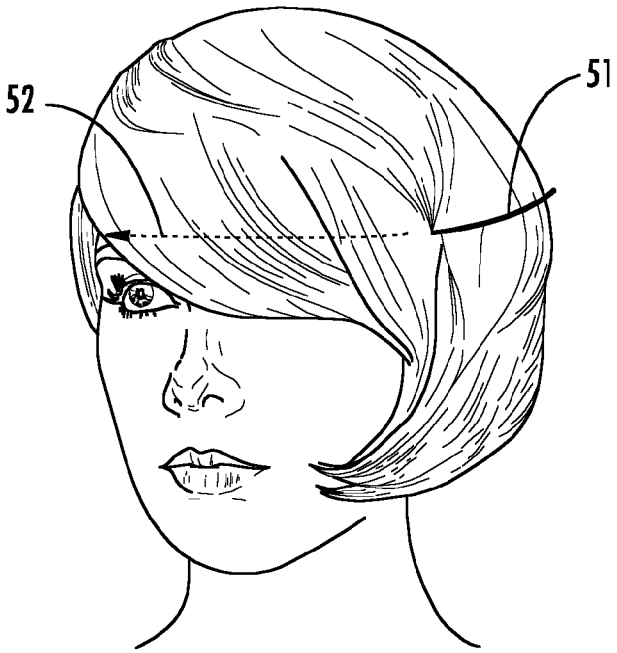
FIG. 5 is an explanatory view illustrating a marker for a guide length in one quadrant.
Figure 6:
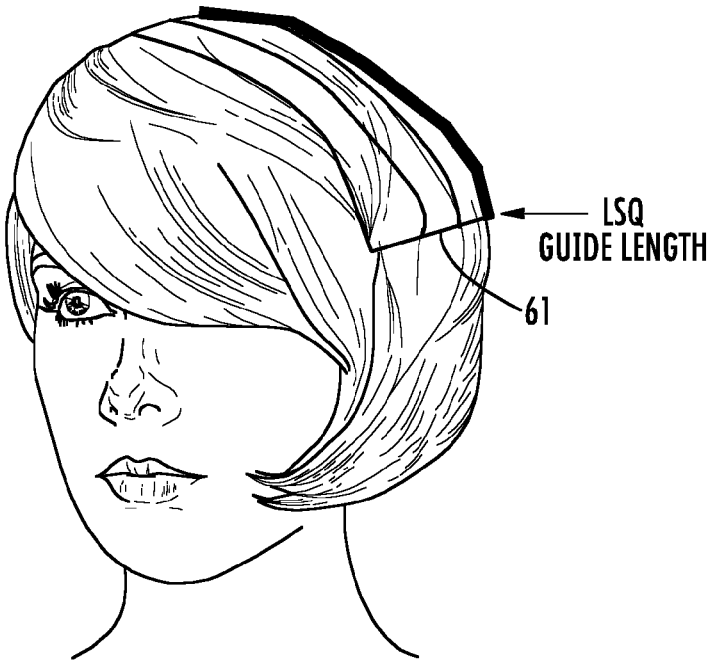
FIG. 6 is an explanatory view illustrating a left side quadrant guide length.

Asymmetrical hairstyles have different shapes on each side of a head. Some hairstyles may be longer in the front of the head and shorter in the back, or vice versa. Additionally, the bang area of a haircut is sometimes shorter than the rest of the haircut. In light of such variations within a specific haircut, each quadrant may have a different guide length. A top guide length is generally only the thickness of a sheet of paper, and it will always be the very top horizontal portion of hair within a quadrant. In hairstyles where the hair in a front quadrant is not falling straight down, but rather it is being styled or pushed over to the side of the quadrant in a diagonal direction, then the guide length would also be taken at a diagonal from the very top of that quadrant. Now referring to FIG. 5, a left side quadrant for a haircut shape is illustrated with a solid line 51 marking where the top piece of hair in that quadrant ends. By observing where that hair ends the hairstylist can visually find a reference point on the client's face that can be used as a marker. Continuing to refer to FIG. 5, an example of such a marker may be just above the client's eyebrow, as indicated by the dashed line with arrowhead 52, for the left side quadrant. FIG. 6 illustrates the thin horizontal section of hair 61 that is coming from the very top of the subject left side quadrant.

Figure 7:
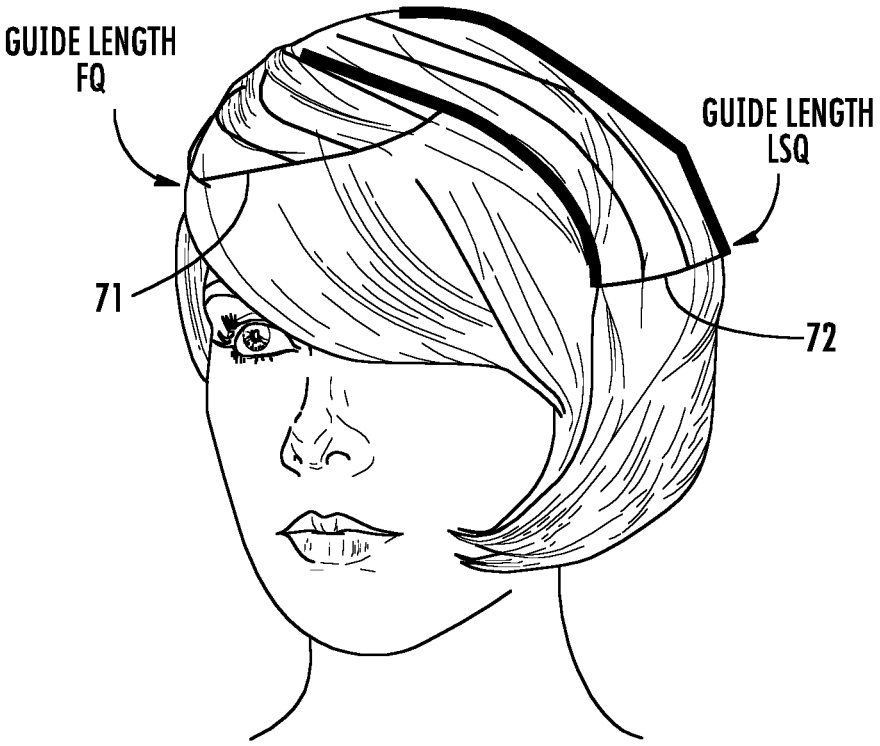
FIG. 7 is an explanatory view illustrating guide lengths for two separate quadrants.
Figure 8B:
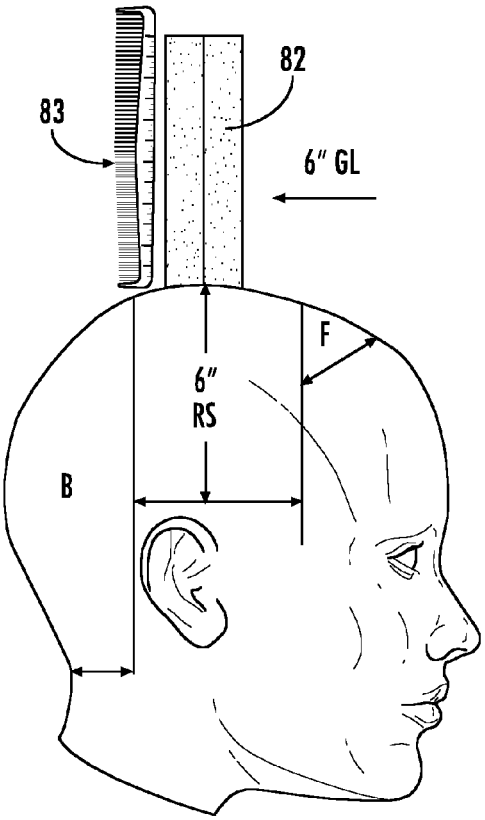
FIG. 8*b* is an explanatory view illustrating measurement of a guide length.
Figure 8A:
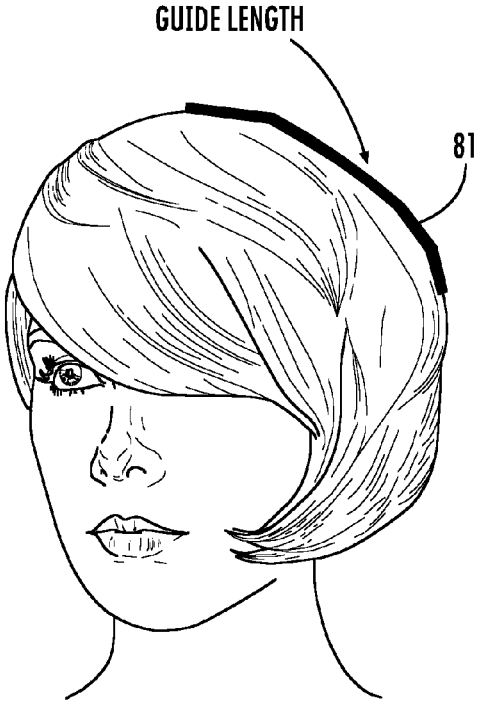
FIG. 8*a* is an explanatory view illustrating a guide length for the left side quadrant.

Now referring to FIG. 7, two different guides lengths in two different quadrants are illustrated. The first being the guide length for the front quadrant 71. The second being the guide length for the left side quadrant 72. Referring to FIG. 8*a*, once the hairstylist cuts the guide length 81 to the appropriate marker, in the present example this being just above the client's eyebrow, now referring to FIG. 8*b*, the hairstylist can take the desired horizontal section of hair 82 and lift it up from the scalp to measure its length, this being 6 inches in the present example. Additionally, as used in the present invention, most hair cutting combs 83 have one inch measurements on their backbone, and as such making it easy to for the hairstylist to use his or her comb as a ruler for measurement purposes when employing the present invention for cutting hair.

Once the hairstylist has established the guide lengths within each quadrant for a client's haircut, the next step in the present inventive method is determining and cutting one or more perimeter lines for the desired haircut. Depending on the specific haircut chosen by the client, each of the perimeter lines will have a desired length and a specific density. The perimeter line is comprised of the hair at the bottom of the hairstyle for each quadrant. The density of the hair at a specific perimeter line is comprised of the hair volume at the perimeter line for a specific quadrant. Similar to the process of using markers for the determination of guide lengths, the hairstylist can utilize a marker when determining a perimeter line.

Figure 9A:
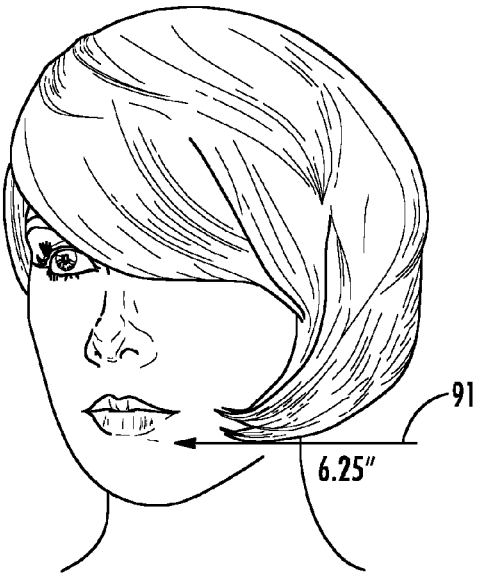
FIG. 9*a* is an explanatory view illustrating a marker to locate a perimeter line.
Figure 9B:
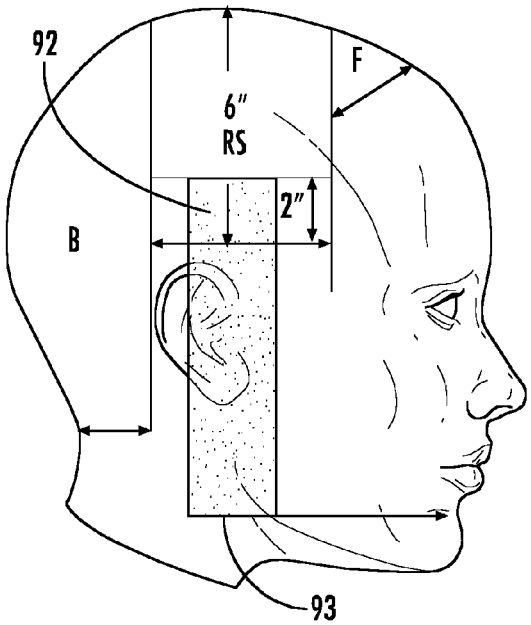
FIG. 9*b* is an explanatory view illustrating density for a perimeter line.
Figure 9C:
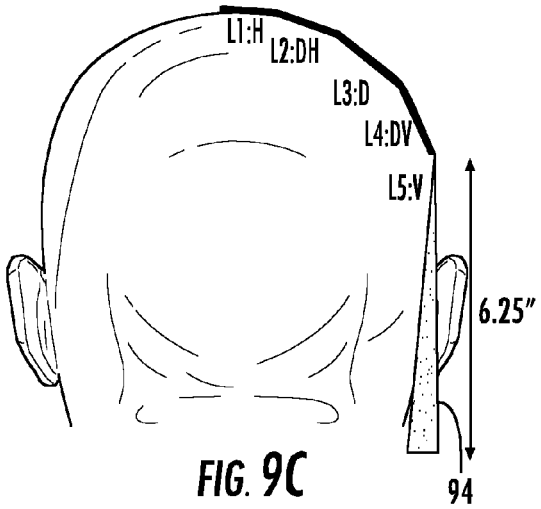
FIG. 9*c* is an explanatory view illustrating the measurement of top section of hair within a perimeter line.
Figure 10A:
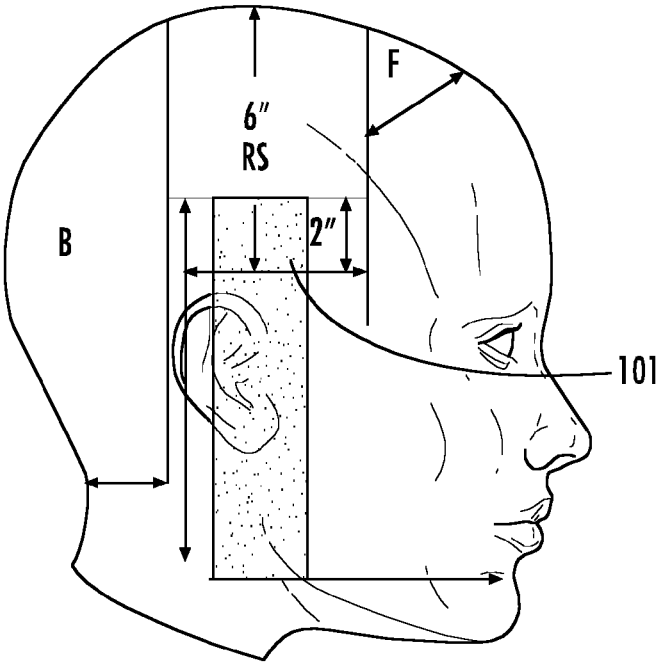
FIG. 10*a* is an explanatory view illustrating a 2 inch increment in perimeter length density.
Figure 10B:
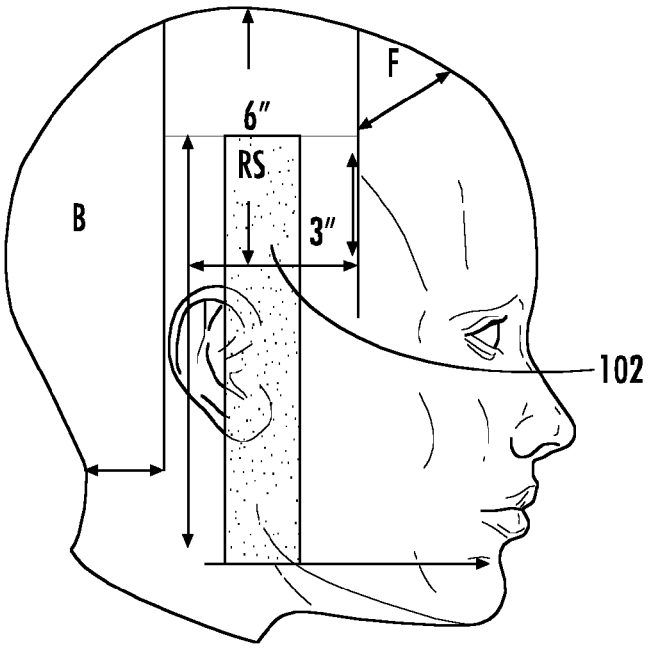
FIG. 10*b* is an explanatory view illustrating a 3 inch increment in perimeter length density.

Now referring to FIG. 9*a*, in the present example the client desires to have the perimeter line 91 fall just below her lips. Before cutting a perimeter line, the hairstylist needs to be aware of the density of the perimeter line in the desired haircut. Depending on the hairstyle of a haircut some perimeter lines are very thick, while other perimeter lines may be thin and wispy in appearance. As previously noted, the perimeter line is the hair that resides at the bottom of a hairstyle, and as such can be compared to the foundation of a house. In order to create the correct density for the perimeter line within each quadrant and sub-quadrant, it is necessary for the hairstylist to clip all the hair in the quadrant up and away from gravity. The hairstylist gradually drops horizontal sections of hair down out of the clip in order to visually determine how thick the hair needs to be to achieve the desired look. The hairstylist can start by releasing the hair directly above the hairline in incremental horizontal sections until the desired density of the perimeter line is achieved. Once the hairstylist has achieved the desired density for the perimeter line needed, the hair comprising the perimeter line is cut to its desired length. Some clients' hair is very thin immediately above the ears, and other clients' hair is very thick immediately above the ears. In such circumstances, it may be necessary for the hairstylist to take a 1-inch tall section of hair in each quadrant and drop that hair down to visually determine if the perimeter line will have the desired density. In the event the 1-inch section of hair is not adequate, it may be necessary to drop down another inch of hair. Referring to FIG. 9*b*, a 2-inch section of hair 92 above the ear is dropped down to establish the correct density for the subject perimeter line 93. Now referring to FIG. 9*c*, it is now possible to measure the very top horizontal section of hair within the perimeter line. Continuing to refer to FIG. 9*c*, the top line of hair 94 that is contributing to the subject perimeter line is 6.25 inches in length. FIG. 10*a* shows that on this particular head shape the thickness of hair above the ear allows for only 2 inches of hair 101 to be dropped down to contribute to the perimeter line density. In FIG. 10*b*, the client's hair was thinner, and as such 3 inches of hair 102 is needed to be incorporated into the perimeter line to give it sufficient density.

Figure 11:
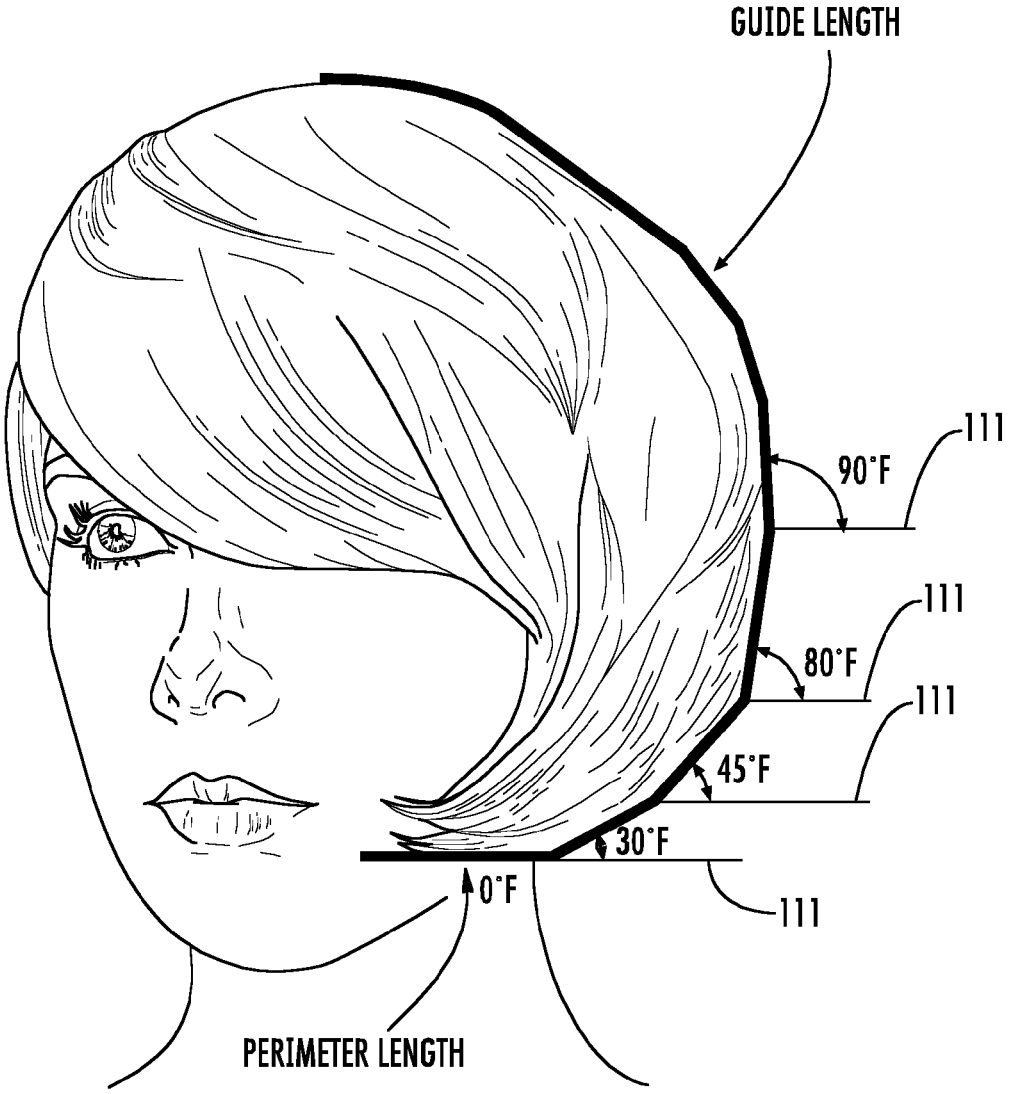
FIG. 11 is an explanatory view illustrating the slope of various fall angles with corresponding horizontal axes.
Figure 12:
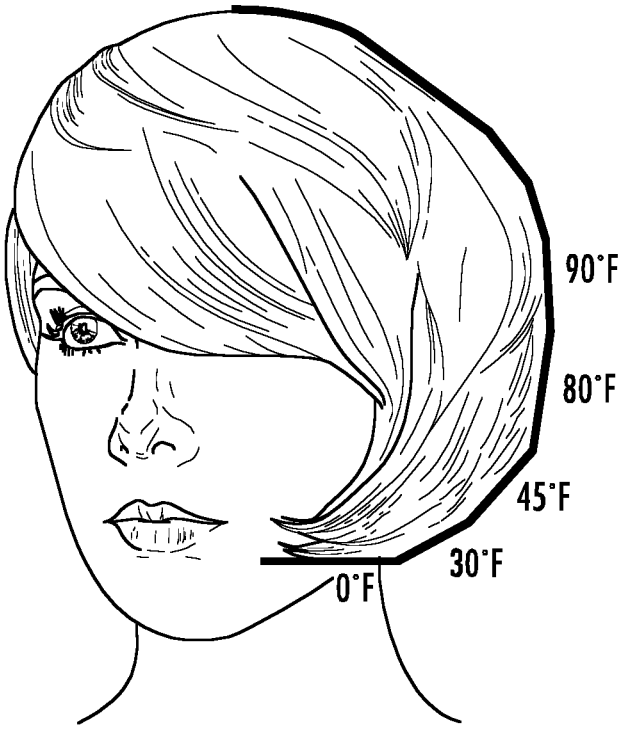
FIG. 12 is an explanatory view illustrating the slopes of various fall angles.

The next step for the present invention is to determine what fall angle, or angles, are giving the haircut style chosen by the client its haircut shape. One or more fall angles can impact a haircut shape and these angles can be located in one or more quadrants. The fall angle is described as the manner in which the hair is distributed when the hair is in a natural fall produced by gravity. The natural fall being the position in which the hair naturally rests. Referring to FIG. 11, the illustrated haircut shape comprises five different fall angles, such angles being identified on the subject FIG. 12 with the following indicia: 0° F., 30° F., 45° F., 80° F., and 90° F. A fall angle is measured in terms of slope, and slope as defined and used in the present invention means an inclined direction or angle considered in reference to a horizontal axis. Continuing to refer to FIG. 11, each fall angle is measured for an incline in reference to its respective horizontal axis 111. At the bottom of FIG. 12, there is no incline from a horizontal axis at that point and therefore the fall angle is 0 degrees. As shown for the haircut illustrated in FIG. 11, as the haircut shape begins to change, a change in incline is observed. Continuing to refer to FIG. 11, the slope measurement of the first fall angle for the first incline from a horizontal axis is labeled as 30° F. Continuing to use the same type of measurement for slope for the haircut, there are 3 additional fall angles in this haircut shape identified as 45° F., 80° F., and 90° F. Referring to FIG. 12, a haircut shape having fall angles of 90° F., 80° F., 45° F., 30° F., and 0° F. is shown without graphing or marking indicia showing a horizontal axis or slope measurements.

In the next step of the present invention it is necessary for the hairstylist to determine the different planes that comprise each of the quadrants. Additionally, each plane of the quadrant also defines a corresponding level for that specific quadrant.

Figure 13:
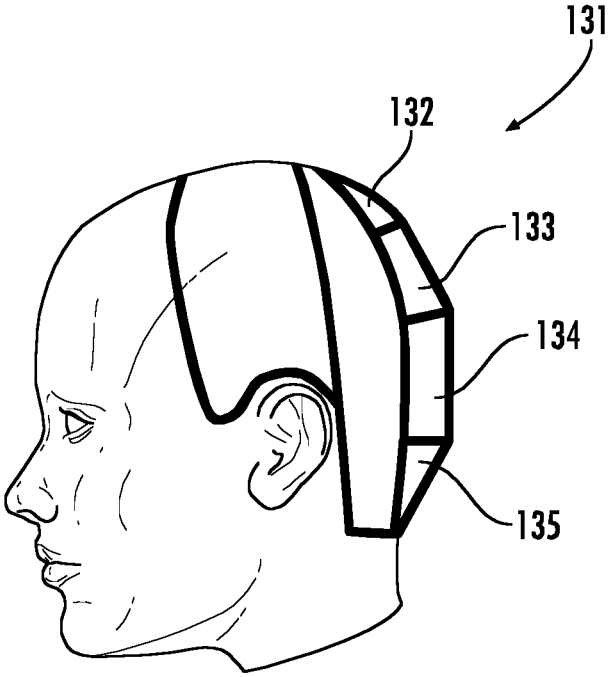
FIG. 13 is an explanatory view illustrating the various planes of a center back quadrant.

In the present example, once the hairstylist has determined details such as the guide length, the perimeter length and density, as well as the fall angles that are creating the shape of the client's desired hairstyle, the next step in the present invention is to determine the different planes that comprise each quadrant. All the planes within a quadrant create a head shape. FIG. 13 illustrates the different shapes of planes 132, 133, 134, 135 as determined by the change of slopes for adjoining planes within the center back sub-quadrant 131 of a person's head.

Figure 14:
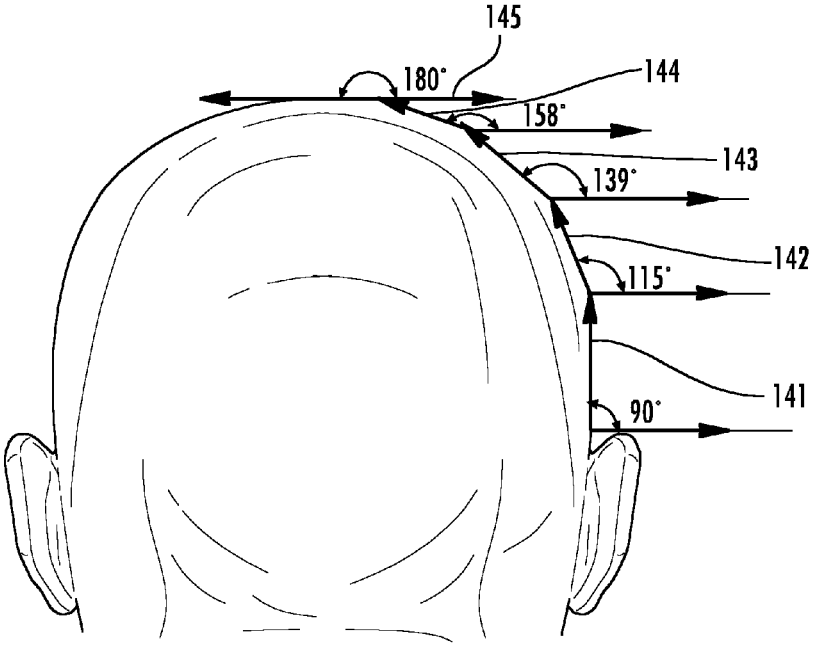
FIG. 14 is an explanatory view illustrating the relationship of planes to horizontal axes.

The planes within a quadrant are adjoining and numerically sequentially adjacent to each other, each plane comprising a slope as determined when traversing downward from the top of the head. A first plane beginning at the top of the client's head, the plane having a first slope. Each subsequent plane begins with each change in the slope within the quadrant. Each additional plane, being numerically sequential to the previous plane adjoining is likewise identified as sequentially numbered adjoining levels, each level comprising the same number and slope as its corresponding plane. Now referring to FIG. 14 for the present example, the plane 141 starting just above the ear in the right side quadrant has a 90 degree slope or incline from a horizontal axis. As the head shape changes the next plane up on the head 142 is sloping at 115 degrees from a horizontal axis. In similar fashion the next plane 143 is sloping at 139 degrees from a horizontal axis. Likewise, the next plane 144 is sloping 158 degrees from the horizontal axis. The top plane 145 is 180 degrees from the horizontal axis. Each plane within a quadrant is labeled according to its slope.

Figure 15:
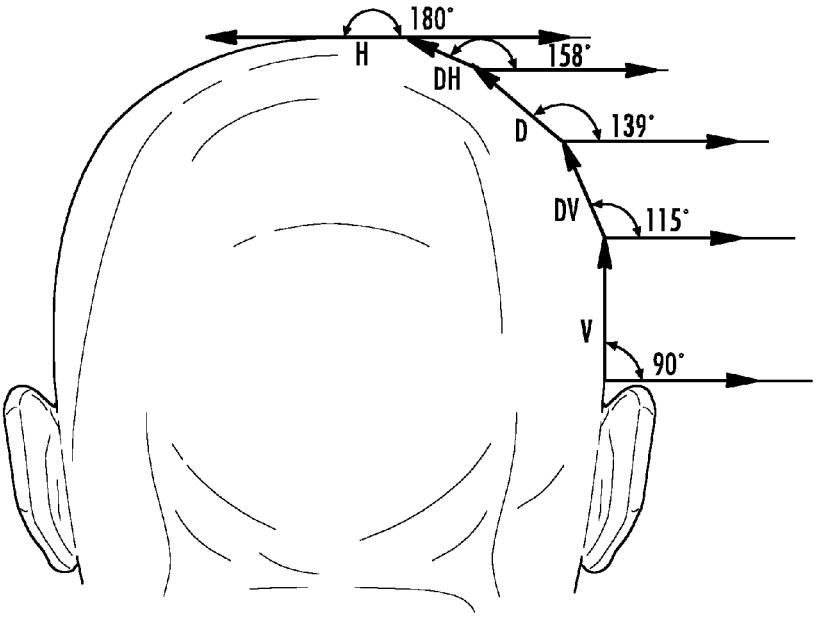
FIG. 15 is an explanatory view illustrating planes in relation to head shape categories.

Each plane within a quadrant is assigned a head shape category designation depending on its degrees of slope. A plane having a slope ranging from 180 degrees to 160 degrees is designated as a horizontal (1-1) head shape category. A plane having a slope ranging from 159 degrees to 140 degrees is designated as a diagonal horizontal (DH) head shape category. A plane having a slope ranging from 139 degrees to 120 degrees is designated as a diagonal (D) head shape category. A plane having a slope ranging from 119 degrees to 110 degrees is designated as a diagonal vertical (DV) head shape category. A plane having a slope ranging from 99 degrees to 80 degrees is designated as a vertical (V) head shape category. A plane having a slope less than 80 degrees is designated as a diagonal down (DD) head shape category. FIG. 15 illustrates how the planes are categorized in the present example. The first plane having a 90 degree slope is designated as a vertical head shape category (V), and is shown on the subject Figure with the letter V. The second plane having a 115 degree slope is designated as a diagonal vertical head shape category (DV), and is shown on the subject Figure with the letters DV. The third plane having a 139 degree slope is designated as a diagonal head shape category (D), and is shown on the subject Figure with the letter D. The fourth plane having a 158 degree slope is designated as a diagonal horizontal head shape category (DH), and is shown on the subject Figure with the letters DH. The fifth plane having a 180 degree slope is designated as a horizontal head shape category (H), and is shown on the subject Figure with the letter H.

Figure 16A:
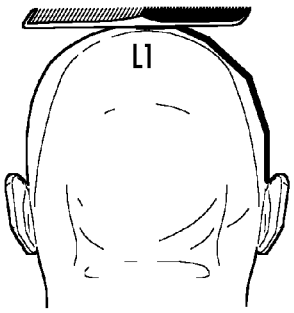
FIG. 16*a* is an explanatory view illustrating comb use to identify a plane.
Figure 16B:
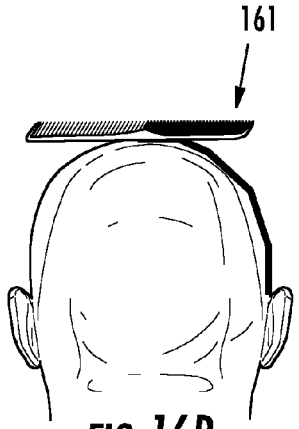
FIG. 16*b* is an explanatory view illustrating comb use to identify a plane.
Figure 16C:
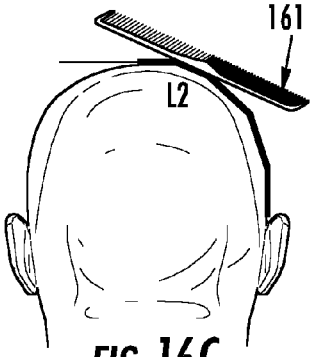
FIG. 16*c* is an explanatory view illustrating comb use to identify a plane.
Figure 16D:
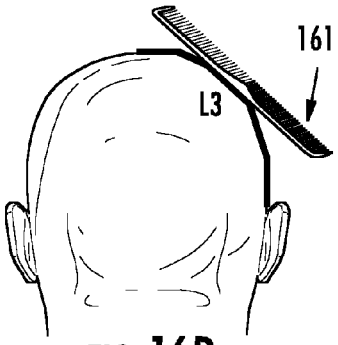
FIG. 16*d* is an explanatory view illustrating comb use to identify a plane.
Figure 16E:
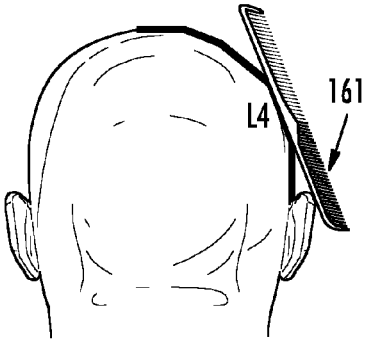
FIG. 16*e* is an explanatory view illustrating comb use to identify a plane.
Figure 16F:
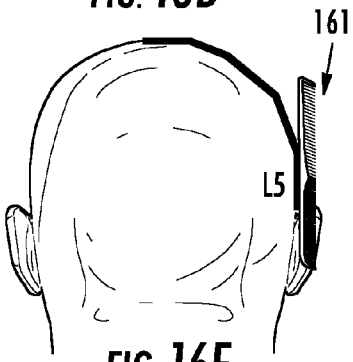
FIG. 16*f* is an explanatory view illustrating comb use to identify a plane.
Figure 17A:
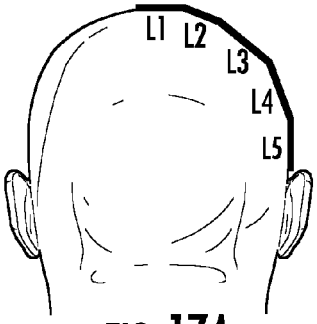
FIG. 17*a* is an explanatory view illustrating sequentially numbered levels.
Figure 17B:
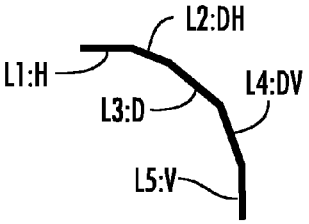
FIG. 17*b* is an explanatory view illustrating levels with respect to head shape categories.
Figure 18:
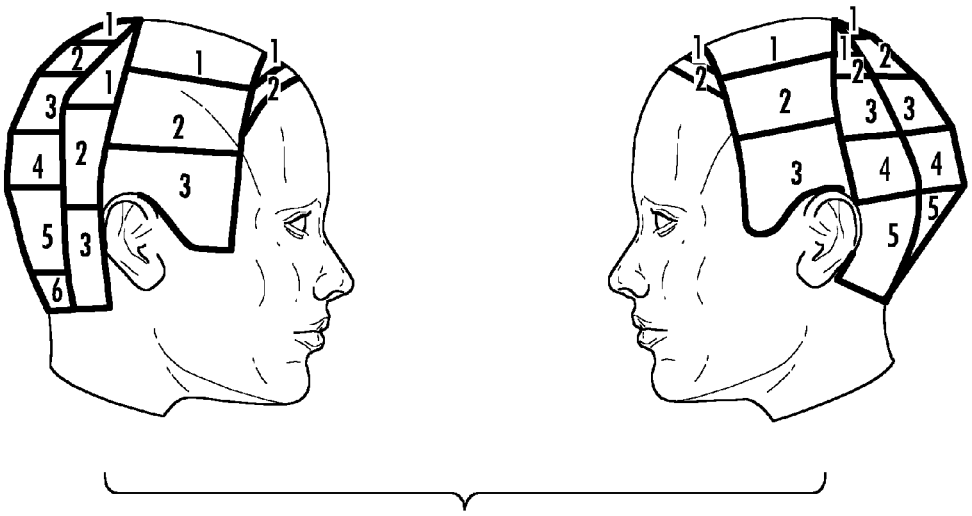
FIG. 18 is an explanatory view illustrating the numbering of planes in quadrants.

When finding the planes of the quadrant, the hairstylist can use a comb to find the slopes for each respective plane. Referring to FIG. 16*a*, the hairstylist starts at the top of the head and places the comb vertical to the quadrant as indicated by the L1 indicia on the drawing. The comb should be placed flat against the 1st plane. If the comb is sloping between 160 and 180 degrees that is considered a horizontal plane and therefore a horizontal head shape category. Once the hairstylist finds the first plane, she next presses down on the end of the comb 161 as illustrated in FIG. 16*b*. Now referring to FIG. 16*c*, the hairstylist presses down on the comb until it comes to rest on a second plane which will be the slope for the second plane as indicated by the L2 indicia on the drawing. Referring to FIGS. 16*d*, 16*e*, and 16*f*, the hairstylist in similar fashion continues to press down on the end of the comb 161 to find the slope of each plane within the quadrant as indicated by the L3, L4, and L5 indicia on the subject Figure. Referring to FIG. 17*a*, each plane is labeled as a level with the indicia L1, L2, L3, L4, and L5 on the subject Figure. Now referring to FIG. 17*b*, each level likewise is a type of plane as indicated with the indicia L1:H, L2:DH, L3:D, L4:DV, and L5:17 on the subject Figure. As such, level 1 being labeled as a horizontal plane, level 2 being labeled as a diagonal horizontal plane, level 3 being labeled as a diagonal plane, level 4 being labeled as a diagonal vertical plane, and level 5 being labeled as a vertical plane. FIG. 18 demonstrates how each quadrant and each sub-quadrant is labeled beginning at the top of the head. Each plane is assigned a number beginning at the top of the head with level 1, and then sequentially numbering each lower plane within that quadrant or sub-quadrant with the next corresponding lower level number.

Figure 19:
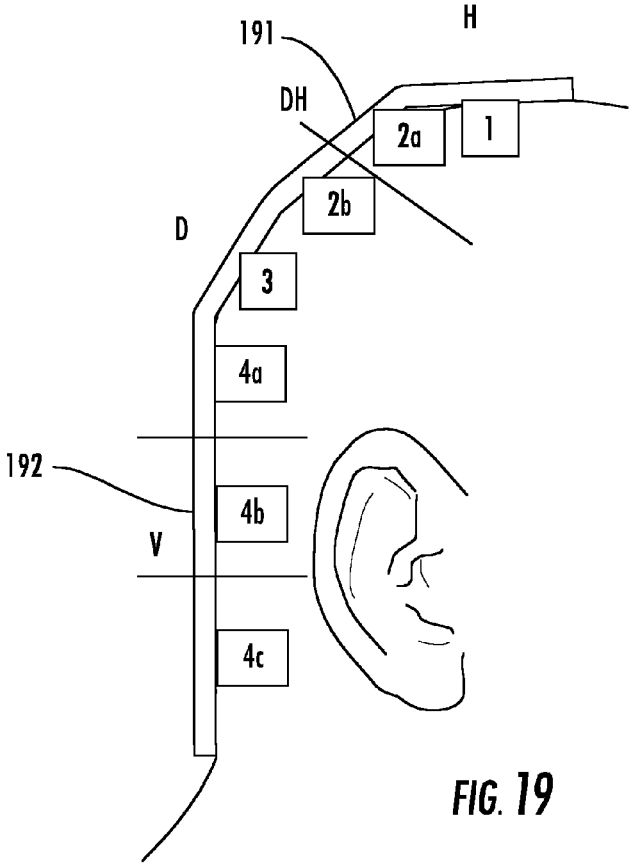
FIG. 19 is an explanatory view illustrating the division of tall planes.
Figure 20:
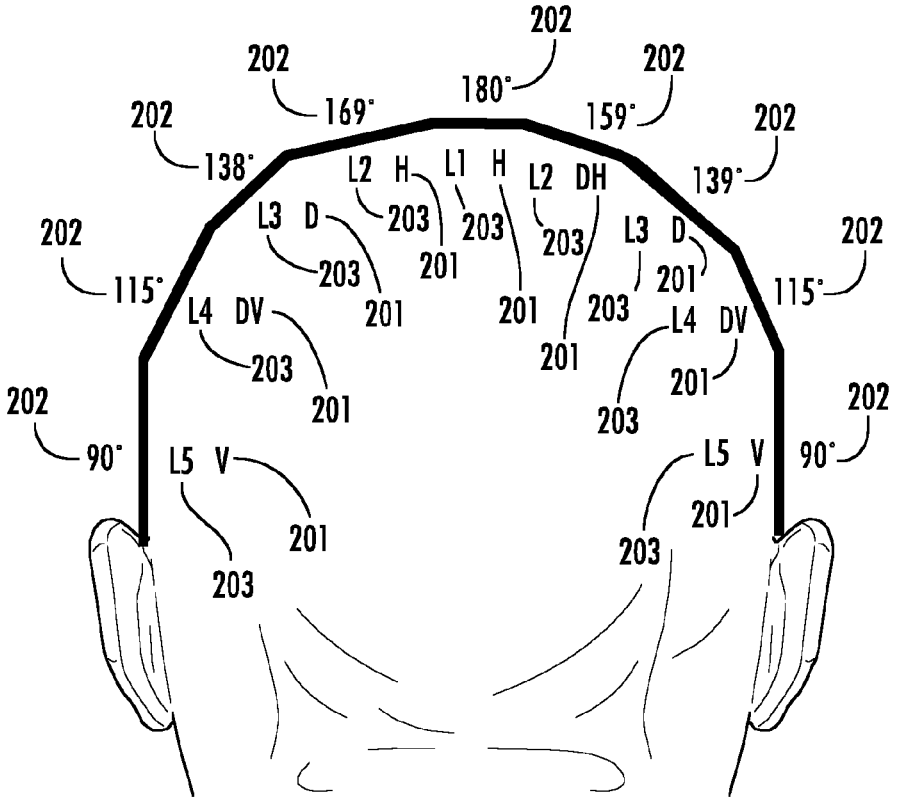
FIG. 20 is an explanatory view illustrating the non-symmetry of a head shape with respect to levels, slopes, and head shape categories.
Figure 21:
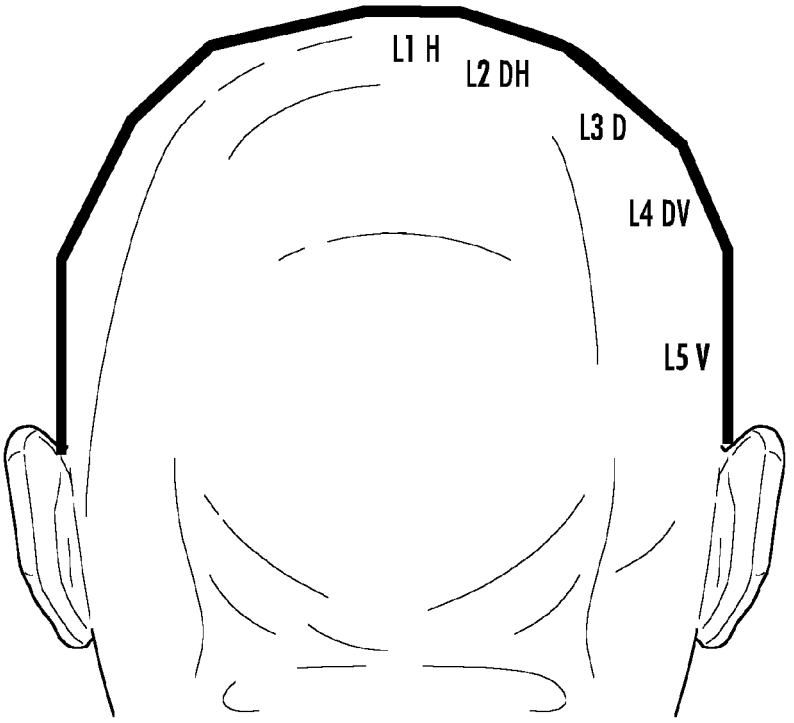
FIG. 21 is an explanatory view illustrating the relationship between levels and head shape categories.

If a plane of the head is taller than one and a half inches, it is necessary to subdivide its corresponding level into sublevels. Referring to FIG. 19, the diagonal horizontal plane 191 is 2 inches tall and it is divided in half and labeled as level 2a and level 2b as shown on the subject Figure. The vertical plane 192 is 3 inch tall and it is subdivided into 3 levels, 4a, 4b, and 4c as shown on the subject Figure. Now referring to FIG. 20, it is important to find the planes within each quadrant, because each quadrant can have different types of planes 201, as shown by the different degrees of slope 202 for corresponding levels 203 and head shape categories. Now referring to FIG. 21, a right side quadrant is labeled with each level number identified as L1, L2, L3, L4, L5, and the corresponding type of plane for each level identified as H, DH, D, DV, V.

In the present example, several items of information have been accumulated by the hairstylist at this point. Referring to FIG. 22*a*, the guide length (GL) 221 is 6 inches long. Referring to FIG. 22*b*, the top of the perimeter length 222 is 6.25 inches long. Now referring to FIG. 22*c*, this information is entered into a Formulation Sheet. Additional information is also available to the hairstylist at this point for the Formulation Sheet. Such information includes the number of quadrants and sub-quadrants as provided in FIGS. 2 and 3, the height of the quadrants and sub-quadrants as illustrated in FIG. 4, the amount of hair needed to contribute to the density of the perimeter line as provided in FIGS. 10*a* and 10*b*, the amount of scalp left to work within after the perimeter density is removed (the height of the quadrant minus the amount of hair contributing to the perimeter), the amount of length needed to increase or decrease within that quadrant (the difference in the guide length and perimeter length), the number and category of each plane within each quadrant FIG. 21, and the fall angles of the desired shape FIG. 12. With this information, the hairstylist can determine if the desired haircut shape can be achieved in light of the client's unique head shape and the density of the client's hair, or if any of the factors need to be adjusted accordingly.

The next step in the present invention is to determine the projection angles at which the client's hair is cut to achieve the desired hairstyle. The projection angles are determined by inputting previously acquired information into a projection chart as necessary to calculate the necessary projection angles.

The information that has been ascertained at this point is a guide length of 6 inches long, as seen in FIG. 22*a*. Additionally, as provided in FIG. 22*b*, it now known that the top of the perimeter line is 6.25 inches long. The hairstylist can now input this information into a Formulation Sheet as seen in FIG. 22*c*.

If the hairstylist wanted to create this haircut shape on the client's right side quadrant, she would input the 6 inch guide length and the 6.25 inch perimeter length into the Formulation Sheet. The hairstylist is therefore informed that from the guide length to the perimeter length she can only gain 0.25 inches in length. The amount of scalp the hairstylist had to work within, in that quadrant was originally 6 inches, but she needed 2 inches for the perimeter density which leaves 4 inches of scalp with which to work. The hairstylist can continue with the Formulation Sheet because she has all of the fall angles as illustrated in FIG. 23*a* and the head shape for the right side quadrant as shown in FIG. 23*b*. The formula is provided as shown in FIG. 23*c*. Level 1 is a horizontal head shape category with a 6 inch guide length and the hairstylist wants the hair to fall into a 90 degree fall angle. Level 2 is a diagonal horizontal head shape category and the guide length unknown, but the hairstylist wants the hair to fall into an 80 degree fall angle. Level 3 is a diagonal head shape category and the hairstylist wants the hair to fall into a 45 degree angle. Level 4 is a diagonal vertical head shape category and the hairstylist wants the hair to fall into a 30 degree fall angle. The hair from level 5a and level 5b has already been cut for the perimeter line at a zero degree fall angle. The hairstylist can now complete the formula by determining the missing values by using the Projection Chart as shown in FIG. 24*a* and the Increase/Decrease Table as illustrated in FIG. 24*b*.

Now referring to FIG. 25, a Projection Chart is shown. At the top of the Projection Chart the planes of the head are listed from left to right; H stands for horizontal, DH is for diagonal horizontal, D is for diagonal, DV is for diagonal vertical, and V is for a vertical plane. There is no diagonal down plane listed on the projection chart, because hair that is coming from a diagonal down plane should be cut in natural fall at the desired angle. As such, there is no need to have the diagonal down plane on the Projection Chart. Guide lengths of 2 inches, 3 inches, 4 inches, 5 inches, and 6 inches are listed immediately below each of the head shape categories. There are no guide length values below 2 inches, because hair shorter than 2 inches does not fall into gravity and therefore should be cut into the desired shape. Also, there are no guide length values above 6 inches, because hair that is longer than 6 inches responds the same to gravity as hair which is 6 inches in length. If a guide length is longer than 6 inches, the 6 inch column should be used.

Continuing to refer to FIG. 25, fall angles are listed on the left side of the Projection Chart. Fall angles range between 180 degrees down to 30 degrees. Hair that falls below 30 degrees does not need to be projected in order to be cut, and therefore it is not included in the Projection Chart. Hair that falls below 30 degrees should be cut in natural fall. The numbers listed on the inside of the Projection Chart are projection angles. Blank spaces or spaces with an "X" indicate that hair cannot achieve that fall angle at that length from that particular plane. Also, projection angles having a value of 135+ means that hair cut at 135 degrees projection or higher will fall into the same fall angle. The higher degree of projection, the more length that will be preserved at the bottom of that plane.

FIG. 26 demonstrates how to use the Projection Chart. If the hairstylist is on a vertical plane of the head and the guide length is 4 inches long, and the hairstylist wants that section of hair to fall into a 75 degree fall angle, the hair should be cut at a 110 degree projection angle. Referring to FIG. 27*a*, a vertical section of hair is shown being pulled from a vertical plane at a 110 degrees projection angle with a guide length of 4 inches. When that hair is cut by the hairstylist, it will fall into a 75 degree fall angle, as seen in FIG. 27*b*.

Now referring to FIG. 28, a table is provided that indicates how much the length of a section will increase or decrease on each plane per 1 inch of scalp, dependent upon the projection angle at which the hair is cut. The Increase or Decrease Chart explains mathematically what the projection angle is doing with the length at the bottom of the vertical section being cut. At 90 degrees the hair at the top and the bottom of a vertical section of hair would remain the same length. A 1 inch tall vertical section of hair cut at 0 degrees from such a plane will decrease the length at the bottom of that section by 1 inch. Referring to FIG. 29, a vertical section of hair cut at 180 degrees from that plane will increase the length at the bottom of that section by 1 inch. If the guide length within that section is 5 inches and the scalp is 1 inch and the hair is cut at 180 degrees, the bottom length of that section will be 6 inches long.

Continuing to refer to FIG. 29, the vertical section of hair is cut at 180 degrees. The guide length is 5 inches long and the plane of the head is 1 inch tall, therefore the bottom length of that vertical section of hair is increased by 1 inch. In the present example if the hairstylist wants to create a haircut shape as seen in FIG. 1, she has all the information needed to complete the Formulation Sheet. The following is an example for using the Increase/Decrease Table. The Formulation Sheet indicates an increase in the length of hair between the guide length and perimeter line by 6 inches, but there is only 4 inches of scalp to work within. If all the levels were cut at 180 degrees, it would only increase the hair length by 4 inches according to the Increase/Decrease Table. As such, the following options are available: 1) Cut the hair shorter at the perimeter length by 2 inches; 2) Leave the guide length longer by 2 inches; 3) Cut the hair from each plane higher than 180 degrees to preserve more than 1 inch from each plane. Preserving 1.5 inches from each plane would increase the hair length by 6 inches. To cut hair higher than 180 degrees it is necessary to take the section of hair to 180 degrees projection and then angle your fingers at the bottom of that section ½ inch away from the right angle.

Referring to FIG. 30, the Projection Chart has been completed with the planes from the right side quadrant, a guide length of 6 inches, and the fall angles for the desired haircut shape. Level 1 is a horizontal plane with a 6 inch guide length. The hairstylist wants the hair to fall into a 90 degree fall angle. The Projection Chart indicates to cut all the hair in that plane at 135 degrees projection. The Increase/Decrease Table indicates that if the hair is cut at 135 degrees projection, the hair has increased the length at the bottom of that level by 0.75 inches. This permits the hairstylist to input the next guide length for level 2. Level 2 is a diagonal horizontal head shape category with a 6.75 inch guide length and the hairstylist wants the hair to fall into an 80 degree fall angle. As provided earlier, hair that has a guide length of 6 inches or longer, the 6 inch column should be used. With this information the hairstylist can find the projection angle for level 2, which will be 110 degrees projection. The table indicates that if the hairstylist cuts hair at 110 degrees projection, then the length at the bottom of that level is increased by 0.25 inches. This will result in a guide length for level 3 that is 7 inches long. The level 3 is a diagonal plane head shape, the guide length is 7 inches, therefore the 6 inch column will be used, the hairstylist wants the hair to fall into a 45 degree fall angle, and the projection angle is therefore 70 degrees projection. The Increase/Decrease Table indicates if the hair is cut at a 70 degree projection angle, then the bottom length is decreased by 0.25 inches, this will make the guide length for level 4 6.75 inches long. Level 4 is a diagonal vertical plane head shape category with a 6.75 inch guide length, the hairstylist wants the hair to fall into a 30 degree fall angle. The projection chart indicates that the hair should be cut at a 60 degree projection angle. The Increase/Decrease Table indicates that if the hair is cut at a 60 degree projection angle, then the bottom length within that level is decreased by 0.50 inches, which makes the bottom length of level 4 6.25 inches and therefore the same length as the perimeter line.

Figure 32:
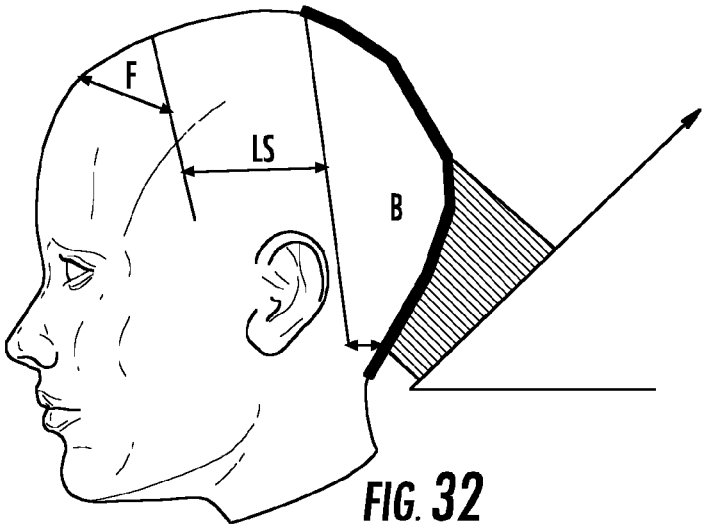
FIG. 32 is an explanatory view illustrating a traditional 45 degree cutting angle.
Figure 33:
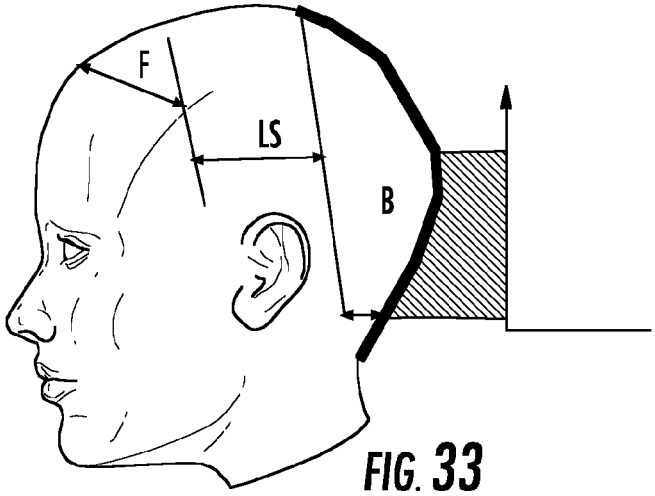
FIG. 33 is an explanatory view illustrating a traditional 90 degree cutting angle.

Referring to FIG. 31, the hairstylist now has all the projection angles needed to create the haircut shape that is desired by the client. With traditional hair cutting, projection angles are found by using slope. The cutting angle is based off of a horizontal axis. Referring to FIG. 32, a traditional 45 degree cutting angle is illustrated. Now referring to FIG. 33, a traditional 90 degree cutting angle is illustrated.

In the final step of the present invention the haircut hairstylist inputs the corresponding the fall angle, head shape, and guide length values into the projection chart for each plane of a client's head to determine the projection angle for the plane to cut the hair in that quadrant.

Figure 34:
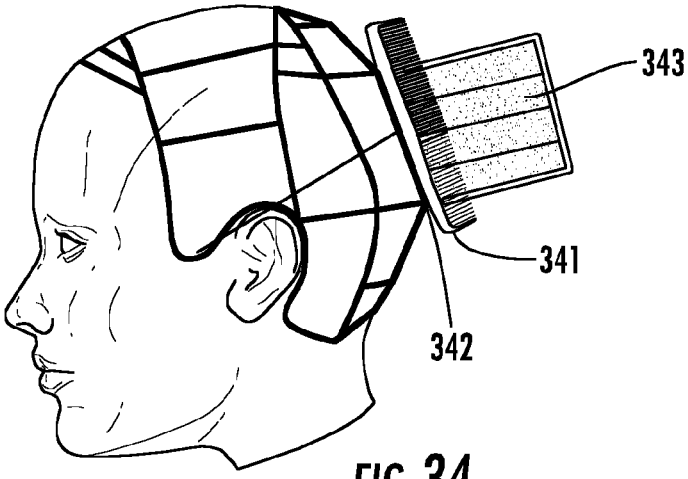
FIG. 34 is an explanatory view illustrating utilization of a comb and hair as a protractor.
Figure 35:
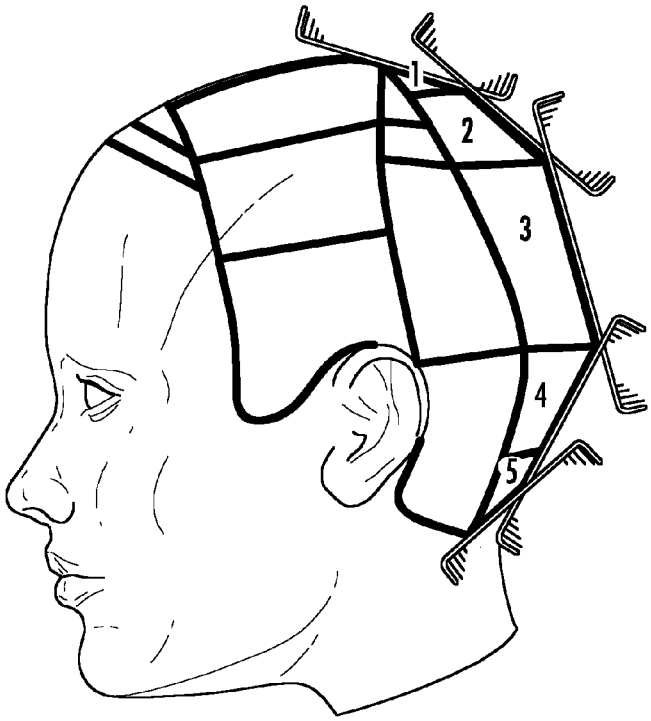
FIG. 35 is an explanatory view illustrating utilization of a comb to locate planes.
Figure 36:
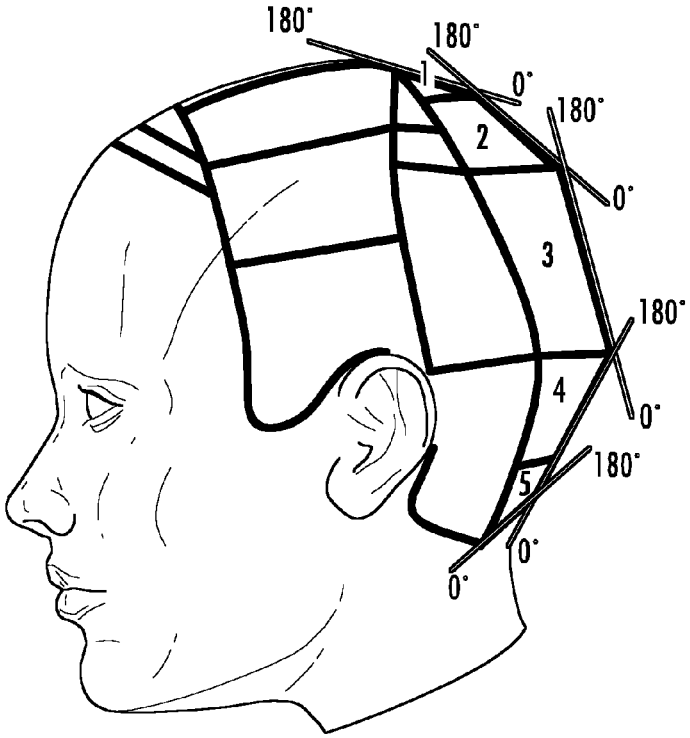
FIG. 36 is an explanatory view illustrating 180 degrees and 0 degrees for each plane.
Figure 37:
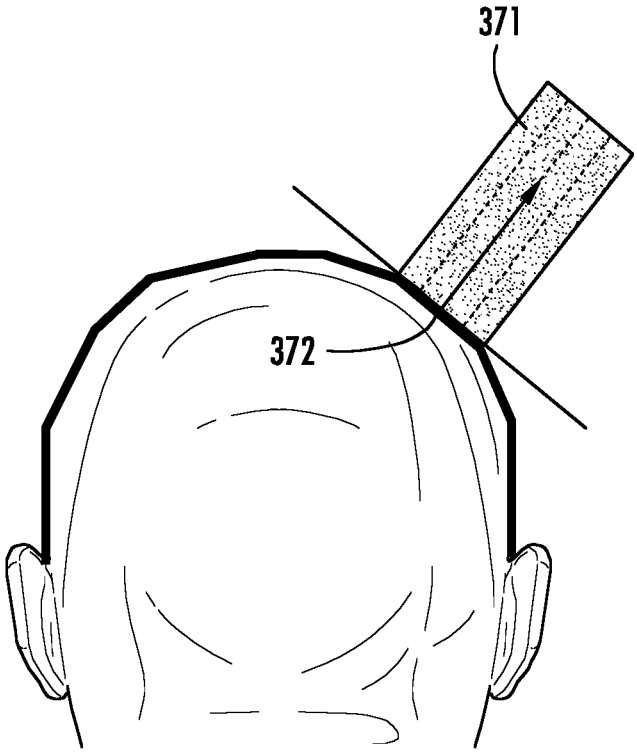
FIG. 37 is an explanatory view illustrating a 90 degree projection angle.
Figure 38:
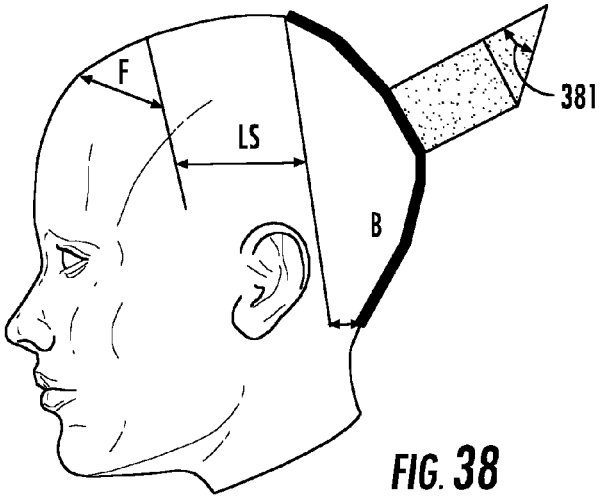
FIG. 38 is an explanatory view illustrating a 45 degree projection angle.
Figure 39:
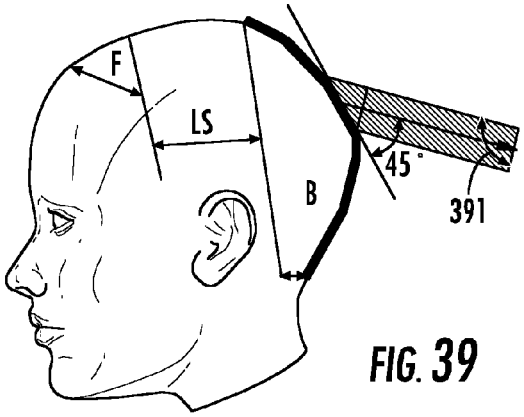
FIG. 39 is an explanatory view illustrating a 45 degree projection angle with preferred method.
Figure 40:
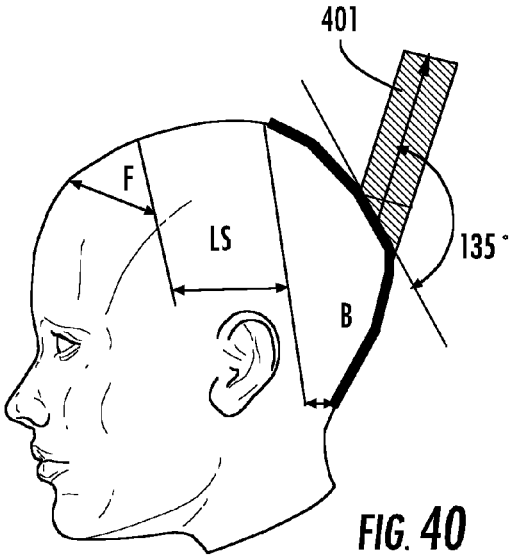
FIG. 40 is an explanatory view illustrating a 135 degree projection angle with preferred method.
Figure 41:
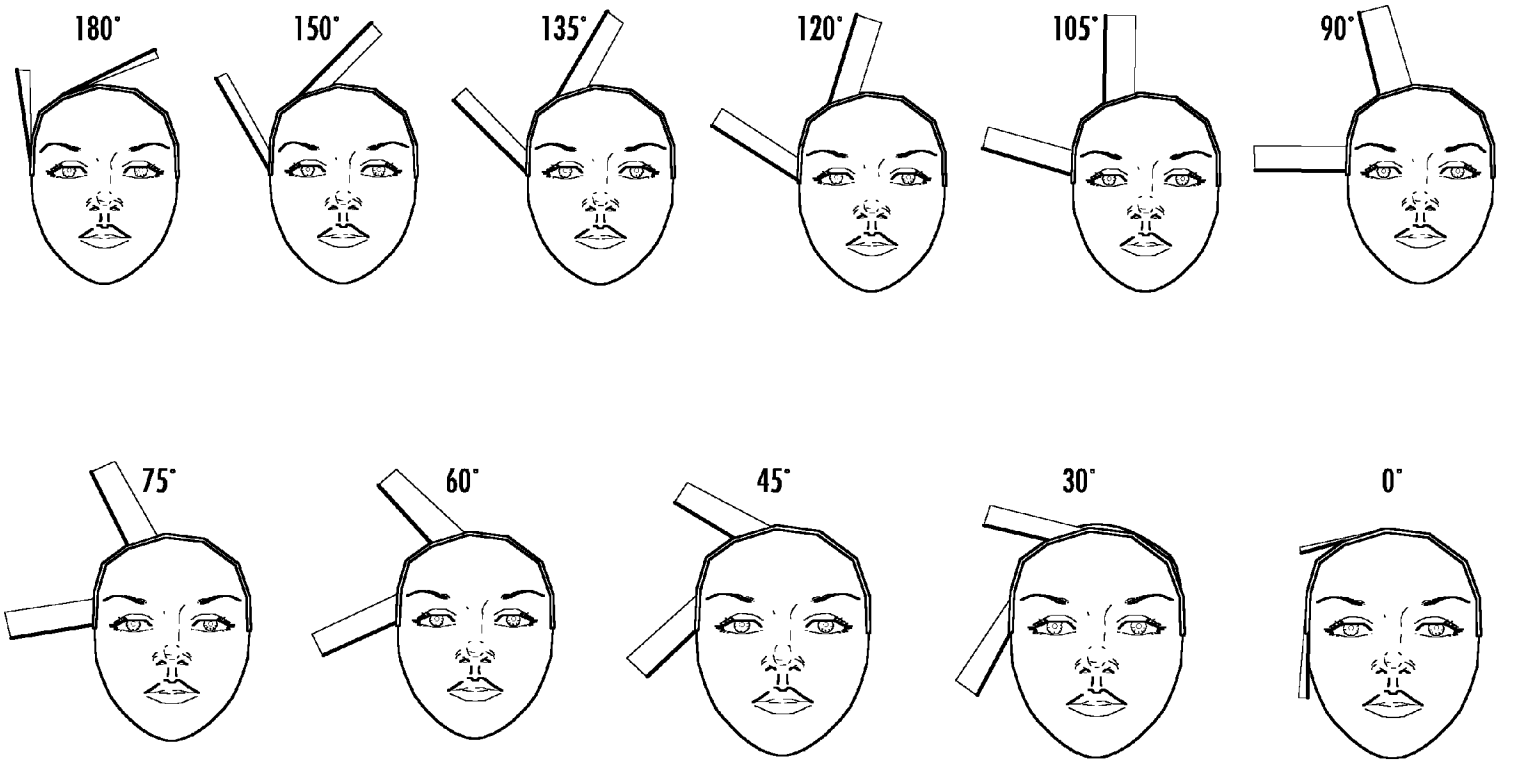
FIG. 41 is an explanatory view illustrating various projection angles for two different planes.

With this method of cutting hair the cutting angles for hair are based on of the planes of the client's head. Referring to FIG. 34, a comb 341 lying flat against the plane 342 of the head acts like the baseline of a protractor. The vertical section of hair 343 acts like the arm of a protractor. The point of origin is the center of the comb placed in the center of the vertical section of hair. Now referring to FIG. 35, provides an illustration of how a comb is placed on each plane of the head acting as a baseline for each plane. With the cutting system of the present invention 0 will always be going towards the natural fall of the hair, and 180 degrees will be going away from the natural fall of the hair, as seen in FIG. 36. Natural fall means: how any section of hair lays without being touched. It is hanging from the scalp in its natural state, naturally being pulled downward by gravity only. Referring to FIG. 37, a vertical section of hair 371 is held at a 90 degree angle from a diagonal plane 372. There are two different techniques that can be used to find the projection angle from the subject plane. Referring to FIG. 38, the first technique is illustrated where the hair is held 90 degrees from the plane and the hairstylist's fingers are angled at the desired projection angle. FIG. 38 illustrates a 45 degree cutting angle 381. Holding a section of hair in this manner can be very difficult to control. The second technique for holding and cutting hair is much easier to control and maintain consistency. Referring to FIG. 39, a vertical section of hair is pulled 45 degrees from the plane and cut at a right angle to the hair 391. As illustrated in FIG. 40, a vertical section of hair 401 is being pulled at 135 degrees projection angle and cut at a right angle on the end of the vertical section of hair. Now referring to FIG. 41, different projection angles are being pulled from two different planes using the second and preferred technique.

Figure 42:
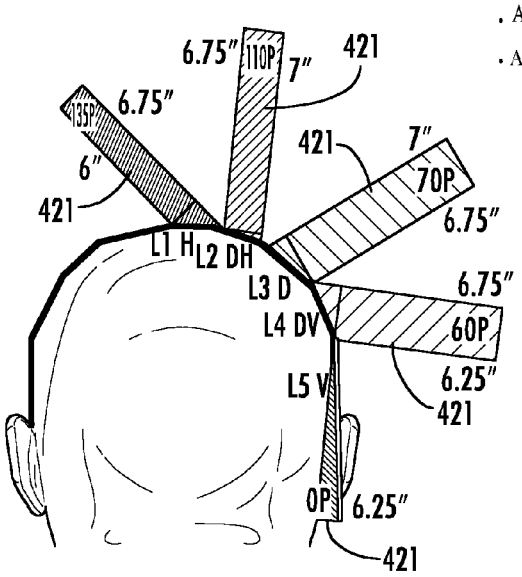
FIG. 42 is an explanatory view illustrating utilization of formulation sheet for cutting projection angles.
Figure 43:
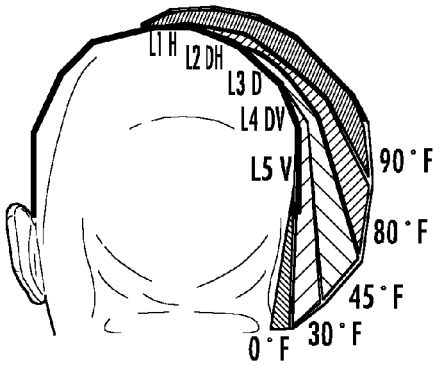
FIG. 43 is an explanatory view illustrating hair in natural fall for the desired haircut.

Referring to FIG. 42, once the hairstylist knows all the projection angles for a quadrant, she can cut the hair 421 into the projection angles, P. Continuing to refer to FIG. 42, level 1 is projected to 135 degree projection angle, the bottom length of level 1 becomes the guide length for level 2, which is cut at a 110 degrees projection angle. The length from the bottom of level 2 becomes the guide length for level 3. Level 3 is cut at a 70 degrees projection angle. Level 4 is cut at a 60 degree projection angle. Both level 5a and level 5b have already been cut in 0 degree projection at the 6.25 inch perimeter length. Once each section of hair has been cut into the desired projection angle and it falls back down into gravity, it will then be at our desired haircut shape as seen in FIG. 43.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein.

That which is claimed:

1. A method for cutting hair resulting in the transformation of said hair into a haircut style using a projection chart to determine a plurality of projection angles by which to cut the hair comprising the steps of:

a hairstylist evaluating a client, the client having a head, said head having a top with a crown and a part, a front side, a left side, a right side, and a back side, each side comprising one or more slopes as determined when traversing downward from the top of the head; a scalp covering said head; a plurality of hair emanating from said scalp, said hair having a plurality of densities and volumes; a front hairline, a left side hairline, a right side hair line, and a back hairline;

the client choosing the haircut style, the haircut style having a haircut shape;

determining a plurality of quadrants on the client's scalp, each of said quadrants comprising a plurality of head shape categories, said categories being a horizontal head shape category, a diagonal horizontal head shape category, a diagonal head shape category, a diagonal vertical head shape category, a vertical head shape category, and a diagonal down head shape category;

determining and cutting one or more guide lengths for said haircut shape for each of said quadrants, said guide lengths comprising 2 inches, 3 inches, 4 inches, 5 inches, and 6 inches;

determining and cutting one or more perimeter lines, each of said perimeter lines having a desired length and a density;

determining one or more fall angles for said haircut shape, said fall angles being located in one or more of said quadrants;

determining a plurality of planes for each of said quadrants, wherein each of said planes define a corresponding level for said quadrants;

determining the plurality of projection angles, wherein said projection angles are determined with the projection chart; and cutting said hair at the projection angle for each plane of each quadrant.

2. The method of claim 1, wherein said plurality of quadrants comprising a front quadrant, a left side quadrant, a right side quadrant, and a back side quadrant, wherein said back quadrant further comprising a left back quadrant, a center back quadrant, and a right back quadrant.

3. The method of claim 2, wherein the front quadrant extends upward from the front hairline to the top of the head; the left side quadrant extends upward from the left side hairline to the top side of the head; the right side quadrant extends upward from the right side hairline to the top side of the head; the back quadrant extends upward from the back hairline to the top of the head; wherein the plurality of said quadrants converge at the crown of the client's head.

4. The method of claim 1, wherein each of said guide lengths comprising a top portion of the hair within each of said quadrants, said top portion of hair running horizontally within the quadrant.

5. The method of claim 1, wherein said perimeter line comprising the hair at the bottom of the hairstyle for each quadrant.

6. The method of claim 1, wherein said density comprising the hair volume at the perimeter line.

7. The method of claim 1, wherein said fall angle being the manner in which the hair is distributed when said hair is in a natural fall produced by gravity, the natural fall being the position in which said hair naturally rests.

8. The method of claim 1, wherein said planes comprising numerically sequential adjoining planes for each of the quadrants, each plane comprising a slope as determined when traversing downward from the top of the head; a first plane beginning at the top of the client's head, said plane having a first slope; each subsequent plane begins with each change in the slope within said quadrant; said plurality of numerically sequential adjoining planes being likewise identified as sequentially numbered adjoining levels, each level comprising the same number and slope as its corresponding plane.

9. The method of claim 8, wherein a plane having a slope ranging from 180 degrees to 160 degrees is designated as a horizontal head shape category; wherein a plane having a slope ranging from 159 degrees to 140 degrees is designated as a diagonal horizontal head shape category; wherein a plane having a slope ranging from 139 degrees to 120 degrees is designated as a diagonal head shape category; wherein a plane having a slope ranging from 119 degrees to 110 degrees is designated as a diagonal vertical head shape category; wherein a plane having a slope ranging from 99 degrees to 80 degrees is designated as a vertical head shape category; wherein a plane having a slope less than 80 degrees is designated as a diagonal down head shape category.

10. The method of claim 1, wherein the hairstylist inputs the fall angle, the head shape category, and the guide length values into the projection chart for each plane of a client's head to determine the projection angle for said plane.

11. The method of claim 1, wherein said projection chart comprising a plurality of head shape categories; a plurality of guides lengths; a plurality of fall angles, and a plurality of projection angles.

12. The method of claim 11, wherein said projection chart comprising a first projection angle of 115 degrees, said first projection angle having said horizontal head shape category with said 2-inch guide length, and a first fall angle of 180 degrees;

a second projection angle of at least 135 degrees, said second projection angle having said horizontal head shape category with said 3-inch guide length, and said first fall angle of 180 degrees;

a third projection angle of 90 degrees, said third projection angle having said horizontal head shape category with said 2-inch guide length, and a second fall angle ranging from 160 degrees to 175 degrees;

a fourth projection angle of 110 degrees, said fourth projection angle having said horizontal head shape category with said 3-inch guide length, and said second fall angle ranging from 160 degrees to 175 degrees;

a fifth projection angle of at least 130 degrees, said fifth projection angle having said horizontal head shape category with said 4-inch guide length, and said second fall angle ranging from 160 degrees to 175 degrees;

a six projection angle of 75 degrees, said six projection angle having said horizontal head shape category with said 2-inch guide length, and a third fall angle ranging from 140 degrees to 155 degrees;

a seventh projection angle of 90 degrees, said seventh projection angle having said horizontal head shape category with said 3-inch guide length, and said third fall angle ranging from 140 degrees to 155 degrees;

an eighth projection angle of 110 degrees, said eighth projection angle having said horizontal head shape category with said 4-inch guide length, and said third fall angle ranging from 140 degrees to 155 degrees;

a ninth projection angle at least 135 degrees, said ninth projection angle having said horizontal head shape category with said 5-inch guide length, and said third fall angle ranging from 140 degrees to 155 degrees;

a tenth projection angle of 65 degrees, said tenth projection angle having said horizontal head shape category with said 2-inch guide length, and a fourth fall angle ranging from 120 degrees to 135 degrees;

an eleventh projection angle of 80 degrees, said eleventh projection angle having said horizontal head shape category with said 3-inch guide length, and said fourth fall angle ranging from 120 degrees to 135 degrees;

a twelfth projection angle of 105 degrees, said twelfth projection angle having said horizontal head shape category with said 4-inch guide length, and said fourth fall angle ranging from 120 degrees to 135 degrees;

a thirteenth projection angle of at least 130 degrees, said thirteenth projection angle having said horizontal head shape category with said 5-inch guide length, and said fourth fall angle ranging from 120 degrees to 135 degrees;

a fourteenth projection angle of 60 degrees, said fourteenth projection angle having said horizontal head shape category with said 2-inch guide length, and a fifth fall angle ranging from 95 degrees to 115 degrees;

a fifteenth projection angle of 70 degrees, said fifteenth projection angle having said horizontal head shape category with said 3-inch guide length, and said fifth fall angle ranging from 95 degrees to 115 degrees;

a sixteenth projection angle of 100 degrees, said sixteen projection angle having said horizontal head shape category with said 4-inch guide length, and said fifth fall angle ranging from 95 degrees to 115 degrees;

a seventeenth projection angle of 120 degrees, said seventeenth projection angle having said horizontal head shape category with said 5-inch guide length, and said fifth fall angle ranging from 95 degrees to 115 degrees;

an eighteenth projection angle of at least 140 degrees, said eighteenth projection angle having said horizontal head shape category with said 6-inch guide length, and said fifth fall angle ranging from 95 degrees to 115 degrees;

a nineteenth projection angle of 60 degrees, said nineteenth projection angle having said horizontal head shape category with said 3-inch guide length, and a sixth fall angle of 90 degrees;

a twentieth projection angle of 95 degrees, said twentieth projection angle having said horizontal head shape category with said 4-inch guide length, and said sixth fall angle of 90 degrees;

a twenty-first projection angle of 110 degrees, said twenty first projection angle having said horizontal head shape category with said 5-inch guide length, and said sixth fall angle of 90 degrees;

a twenty-second projection angle of at least 135 degrees, said twenty second projection angle having said horizontal head shape category with said 6-inch guide length, and said sixth fall angle of 90 degrees;

a twenty-third projection angle of 40 degrees, said twenty third projection angle having said horizontal head shape category with said 3-inch guide length, and a seventh fall angle ranging from 75 degrees to 85 degrees;

a twenty-fourth projection angle of 65 degrees, said twenty fourth projection angle having said horizontal head shape category with said 4-inch guide length, and said seventh fall angle ranging from 75 degrees to 85 degrees;

a twenty-fifth projection angle of 90 degrees, said twenty fifth projection angle having said horizontal head shape category with said 5-inch guide length, and said seventh fall angle ranging from 75 degrees to 85 degrees;

a twenty-sixth projection angle of 110 degrees, said twenty sixth projection angle having said horizontal head shape category with said 6-inch guide length, and said seventh fall angle ranging from 75 degrees to 85 degrees;

a twenty-seventh projection angle of 30 degrees, said twenty seventh projection angle having said horizontal head shape category with said 3-inch guide length, and an eighth fall angle ranging from 60 degrees to 70 degrees;

a twenty-eighth projection angle of 50 degrees, said twenty eighth projection angle having said horizontal head shape category with said 4-inch guide length, and said eighth fall angle ranging from 60 degrees to 70 degrees;

a twenty-ninth projection angle of 70 degrees, said twenty ninth projection angle having said horizontal head shape category with said 5-inch guide length, and said eighth fall angle ranging from 60 degrees to 70 degrees;

a thirtieth projection angle of 90 degrees, said thirtieth projection angle having said horizontal head shape category with said 6-inch guide length, and said eighth fall angle ranging from 60 degrees to 70 degrees;

a thirty-first projection angle of 15 degrees, said thirty first projection angle having said horizontal head shape category with said 3-inch guide length, and a ninth fall angle ranging from 45 degrees to 55 degrees;

a thirty-second projection angle of 30 degrees, said thirty second projection angle having said horizontal head shape category with said 4-inch guide length, and said ninth fall angle ranging from 45 degrees to 55 degrees;

a thirty-third projection angle of 50 degrees, said thirty third projection angle having said horizontal head shape category with said 5-inch guide length, and said ninth fall angle ranging from 45 degrees to 55 degrees;

a thirty-fourth projection angle of 70 degrees, said thirty fourth projection angle having said horizontal head shape category with said 6-inch guide length, and said ninth fall angle ranging from 45 degrees to 55 degrees;

a thirty-fifth projection angle of 0 degrees, said thirty fifth projection angle having said horizontal head shape category with said 3-inch guide length, and a tenth fall angle ranging from 30 degrees to 40 degrees;

a thirty-sixth projection angle of 20 degrees, said thirty sixth projection angle having said horizontal head shape category with said 4-inch guide length, and said tenth fall angle ranging from 30 degrees to 40 degrees;

a thirty-seventh projection angle of 40 degrees, said thirty seventh projection angle having said horizontal head shape category with said 5-inch guide length, and said tenth fall angle ranging from 30 degrees to 40 degrees;

a thirty-eighth projection angle of 60 degrees, said thirty eighth projection angle having said horizontal head shape category with said 6-inch guide length, and said tenth fall angle ranging from 30 degrees to 40 degrees;

a thirty-ninth projection angle of at least 135 degrees, said thirty ninth projection angle having said diagonal horizontal head shape category with said 2-inch guide length, and said first fall angle of 180 degrees;

a fortieth projection angle of 110 degrees, said fortieth projection angle having said diagonal horizontal head shape category with said 2-inch guide length, and said second fall angle ranging from 160 degrees to 175 degrees;

a forty-first projection angle of at least 130 degrees, said forty first projection angle having said diagonal horizontal head shape category with said 3-inch guide length, and said second fall angle ranging from 160 degrees to 175 degrees;

a forty-second projection angle of 95 degrees, said forty second projection angle having said diagonal horizontal head shape category with said 2-inch guide length, and said third fall angle ranging from 140 degrees to 155 degrees;

a forty-third projection angle of 115 degrees, said forty third projection angle having said diagonal horizontal head shape category with said 3-inch guide length, and said third fall angle ranging from 140 degrees to 155 degrees;

a forty-fourth projection angle of at least 130 degrees, said forty fourth projection angle having said diagonal horizontal head shape category with said 4-inch guide length, and said third fall angle ranging from 140 degrees to 155 degrees;

a forty-fifth projection angle of 90 degrees, said forty fifth projection angle having said diagonal horizontal head shape category with said 2-inch guide length, and said fourth fall angle ranging from 120 degrees to 135 degrees;

a forty-sixth projection angle of 105 degrees, said forty sixth projection angle having said diagonal horizontal head shape category with said 3-inch guide length, and said fourth fall angle ranging from 120 degrees to 135 degrees;

a forty-seventh projection angle of 120 degrees, said forty seventh projection angle having said diagonal horizontal head shape category with said 4-inch guide length, and said fourth fall angle ranging from 120 degrees to 135 degrees;

a forty-eighth projection angle of at least 135 degrees, said forty eighth projection angle having said diagonal horizontal head shape category with said 5-inch guide length, and said fourth fall angle ranging from 120 degrees to 135 degrees;

a forty-ninth projection angle of 80 degrees, said forty ninth projection angle having said diagonal horizontal head shape category with said 2-inch guide length, and said fifth fall angle ranging from 95 degrees to 115 degrees;

a fiftieth projection angle of 95 degrees, said fiftieth projection angle having said diagonal horizontal head shape category with said 3-inch guide length, and said fifth fall angle ranging from 95 degrees to 115 degrees;

a fifty-first projection angle of 110 degrees, said fifty first projection angle having said diagonal horizontal head shape category with said 4-inch guide length, and said fifth fall angle ranging from 95 degrees to 115 degrees;

a fifty-second projection angle of 125 degrees, said fifty second projection angle having said diagonal horizontal head shape category with said 5-inch guide length, and said fifth fall angle ranging from 95 degrees to 115 degrees;

a fifty-third projection angle of at least 140 degrees, said fifty third projection angle having said diagonal horizontal head shape category with said 6-inch guide length, and said fifth fall angle ranging from 95 degrees to 115 degrees;

a fifty-fourth projection angle of 75 degrees, said fifty fourth projection angle having said diagonal horizontal head shape category with said 2-inch guide length, and said sixth fall angle of 90 degrees;

a fifty-fifth projection angle of 90 degrees, said fifty fifth projection angle having said diagonal horizontal head shape category with said 3-inch guide length, and said sixth fall angle of 90 degrees;

a fifty-sixth projection angle of 105 degrees, said fifty sixth projection angle having said diagonal horizontal head shape category with said 4-inch guide length, and said sixth fall angle of 90 degrees;

a fifty-seventh projection angle of 120 degrees, said fifty seventh projection angle having said diagonal horizontal head shape category with said 5-inch guide length, and said sixth fall angle of 90 degrees;

a fifty-eighth projection angle of at least 135 degrees, said fifty eighth projection angle having said diagonal horizontal head shape category with said 6-inch guide length, and said sixth fall angle of 90 degrees;

a fifty-ninth projection angle of 40 degrees, said fifty ninth projection angle having said diagonal horizontal head shape category with said 2-inch guide length, and said seventh fall angle ranging from 75 degrees to 85 degrees;

a sixtieth projection angle of 55 degrees, said sixtieth projection angle having said diagonal horizontal head shape category with said 3-inch guide length, and said seventh fall angle ranging from 75 degrees to 85 degrees;

a sixty-first projection angle of 70 degrees, said sixty first projection angle having said diagonal horizontal head shape category with said 4-inch guide length, and said seventh fall angle ranging from 75 degrees to 85 degrees;

a sixty-second projection angle of 95 degrees, said sixty second projection angle having said diagonal horizontal head shape category with said 5-inch guide length, and said seventh fall angle ranging from 75 degrees to 85 degrees;

a sixty-third projection angle of 110 degrees, said sixty third projection angle having said diagonal horizontal head shape category with said 6-inch guide length, and said seventh fall angle ranging from 75 degrees to 85 degrees;

a sixty-fourth projection angle of 30 degrees, said sixty fourth projection angle having said diagonal horizontal head shape category with said 2-inch guide length, and said eighth fall angle ranging from 60 degrees to 70 degrees;

a sixty-fifth projection angle of 45 degrees, said sixty fifth projection angle having said diagonal horizontal head shape category with said 3-inch guide length, and said eighth fall angle ranging from 60 degrees to 70 degrees;

a sixty-sixth projection angle of 60 degrees, said sixty sixth projection angle having said diagonal horizontal head shape category with said 4-inch guide length, and said eighth fall angle ranging from 60 degrees to 70 degrees;

a sixty-seventh projection angle of 75 degrees, said sixty seventh projection angle having said diagonal horizontal head shape category with said 5-inch guide length, and said eighth fall angle ranging from 60 degrees to 70 degrees;

a sixty-eighth projection angle of 90 degrees, said sixty eighth projection angle having said diagonal horizontal head shape category with said 6-inch guide length, and said eighth fall angle ranging from 60 degrees to 70 degrees;

a sixty-ninth projection angle of 10 degrees, said sixty ninth projection angle having said diagonal horizontal head shape category with said 2-inch guide length, and said ninth fall angle ranging from 45 degrees to 55 degrees;

a seventieth projection angle of 25 degrees, said seventieth projection angle having said diagonal horizontal head shape category with said 3-inch guide length, and said ninth fall angle ranging from 45 degrees to 55 degrees;

a seventy-first projection angle of 40 degrees, said seventy first projection angle having said diagonal horizontal head shape category with said 4-inch guide length, and said ninth fall angle ranging from 45 degrees to 55 degrees;

a seventy-second projection angle of 55 degrees, said seventy second projection angle having said diagonal horizontal head shape category with said 5-inch guide length, and said ninth fall angle ranging from 45 degrees to 55 degrees;

a seventy-third projection angle of 70 degrees, said seventy third projection angle having said diagonal horizontal head shape category with said 6-inch guide length, and said ninth fall angle ranging from 45 degrees to 55 degrees;

a seventy-fourth projection angle of 0 degrees, said seventy fourth projection angle having said diagonal horizontal head shape category with said 2-inch guide length, and said tenth fall angle ranging from 30 degrees to 40 degrees;

a seventy-fifth projection angle of 15 degrees, said seventy fifth projection angle having said diagonal horizontal head shape category with said 3-inch guide length, and said tenth fall angle ranging from 30 degrees to 40 degrees;

a seventy-sixth projection angle of 30 degrees, said seventy sixth projection angle having said diagonal horizontal head shape category with said 4-inch guide length, and said tenth fall angle ranging from 30 degrees to 40 degrees;

a seventy-seventh projection angle of 45 degrees, said seventy seventh projection angle having said diagonal horizontal head shape category with said 5-inch guide length, and said tenth fall angle ranging from 30 degrees to 40 degrees;

a seventy-eighth projection angle of 60 degrees, said seventy eighth projection angle having said diagonal horizontal head shape category with said 6-inch guide length, and said tenth fall angle ranging from 30 degrees to 40 degrees;

a seventy-ninth projection angle of at least 135 degrees, said seventy ninth projection angle having said diagonal head shape category with said 2-inch guide length, and said second fall angle ranging from 160 degrees to 175 degrees;

an eightieth projection angle of 115 degrees, said eightieth projection angle having said diagonal head shape category with said 2-inch guide length, and said third fall angle ranging from 140 degrees to 155 degrees;

an eighty-first projection angle of at least 130 degrees, said eighty-first projection angle having said diagonal head shape category with said 3-inch guide length, and said third fall angle ranging from 140 degrees to 155 degrees;

an eighty-second projection angle of 105 degrees, said eighty-second projection angle having said diagonal head shape category with said 2-inch guide length, and said fourth fall angle ranging from 120 degrees to 135 degrees;

an eighty-third projection angle of 120 degrees, said eighty-third projection angle having said diagonal head shape category with said 3-inch guide length, and said fourth fall angle ranging from 120 degrees to 135 degrees;

an eighty-fourth projection angle of 130 degrees, said eighty-fourth projection angle having said diagonal head shape category with said 4-inch guide length, and said fourth fall angle ranging from 120 degrees to 135 degrees;

an eighty-fifth projection angle of at least 140 degrees, said eighty-fifth projection angle having said diagonal head shape category with said 5-inch guide length, and said fourth fall angle ranging from 120 degrees to 135 degrees;

an eighty-sixth projection angle of 100 degrees, said eighty-sixth projection angle having said diagonal head shape category with said 2-inch guide length, and said fifth fall angle ranging from 95 degrees to 115 degrees;

an eighty-seventh projection angle of 110 degrees, said eighty-seventy projection angle having said diagonal head shape category with said 3-inch guide length, and said fifth fall angle ranging from 95 degrees to 115 degrees;

an eighty-eighth projection angle of 120 degrees, said eighty-eighth projection angle having said diagonal head shape category with said 4-inch guide length, and said fifth fall angle ranging from 95 degrees to 115 degrees;

an eighty-ninth projection angle of 130 degrees, said eighty-ninth projection angle having said diagonal head shape category with said 5-inch guide length, and said fifth fall angle ranging from 95 degrees to 115 degrees;

a ninetieth projection angle of at least 140 degrees, said ninetieth projection angle having said diagonal head shape category with said 6-inch guide length, and said fifth fall angle ranging from 95 degrees to 115 degrees;

a ninety-first projection angle of 90 degrees, said ninety-first projection angle having said diagonal head shape category with said 2-inch guide length, and said sixth fail angle of 90 degrees;

a ninety-second projection angle of 100 degrees, said ninety-second projection angle having said diagonal head shape category with said 3-inch guide length, and said sixth fall angle of 90 degrees;

a ninety-third projection angle of 115 degrees, said ninety-third projection angle having said diagonal head shape category with said 4-inch guide length, and said sixth fall angle of 90 degrees;

a ninety-fourth projection angle of 125 degrees, said ninety-fourth projection angle having said diagonal head shape category with said 5-inch guide length, and said sixth fall angle of 90 degrees;

a ninety-fifth projection angle of at least 135 degrees, said ninety-fifth projection angle having said diagonal head shape category with said 6-inch guide length, and said sixth fall angle of 90 degrees;

a ninety-sixth projection angle of 70 degrees, said ninety-sixth projection angle having said diagonal head shape category with said 2-inch guide length, and said seventh fall angle ranging from 75 degrees to 85 degrees;

a ninety-seventh projection angle of 80 degrees, said ninety-seventh projection angle having said diagonal head shape category with said 3-inch guide length, and said seventh fall angle ranging from 75 degrees to 85 degrees;

a ninety-eighth projection angle of 90 degrees, said ninety-eighth projection angle having said diagonal head shape category with said 4-inch guide length, and said seventh fall angle ranging from 75 degrees to 85 degrees;

a ninety-ninth projection angle of 100 degrees, said ninety-ninth projection angle having said diagonal head shape category with said 5-inch guide length, and said seventh fall angle ranging from 75 degrees to 85 degrees;

a one hundredth projection angle of 110 degrees, said one hundredth projection angle having said diagonal head shape category with said 6-inch guide length, and said seventh fall angle ranging from 75 degrees to 85 degrees;

a one hundredth and first projection angle of 50 degrees, said one hundredth and first projection angle having said diagonal head shape category with said 2-inch guide length, and said eighth fall angle ranging from 60 degrees to 70 degrees;

a one hundredth and second projection angle of 60 degrees, said one hundredth and second projection angle having said diagonal head shape category with said 3-inch guide length, and said eighth fall angle ranging from 60 degrees to 70 degrees;

a one hundredth and third projection angle of 70 degrees, said one hundredth and third projection angle having said diagonal head shape category with said 4-inch guide length, and said eighth fall angle ranging from 60 degrees to 70 degrees;

a one hundredth and fourth projection angle of 80 degrees, said one hundredth and fourth projection angle having said diagonal head shape category with said 5-inch guide length, and said eighth fall angle ranging from 60 degrees to 70 degrees;

a one hundredth and fifth projection angle of 90 degrees, said one hundredth and fifth projection angle having said diagonal head shape category with said 6-inch guide length, and said eighth fall angle ranging from 60 degrees to 70 degrees;

a one hundredth and sixth projection angle of 30 degrees, said one hundredth and sixth projection angle having said diagonal head shape category with said 2-inch guide length, and said ninth fall angle ranging from 45 degrees to 55 degrees;

a one hundredth and seventh projection angle of 40 degrees, said one hundredth and seventh projection angle having said diagonal head shape category with said 3-inch guide length, and said ninth fall angle ranging from 45 degrees to 55 degrees;

a one hundredth and eighth projection angle of 50 degrees, said one hundredth and eighth projection angle having said diagonal head shape category with said 4-inch guide length, and said ninth fall angle ranging from 45 degrees to 55 degrees;

a one hundredth and ninth projection angle of 60 degrees, said one hundredth and ninth projection angle having said diagonal head shape category with said 5-inch guide length, and said ninth fall angle ranging from 45 degrees to 55 degrees;

a one hundredth and tenth projection angle of 70 degrees, said one hundredth and tenth projection angle having said diagonal head shape category with said 6-inch guide length, and said ninth fall angle ranging from 45 degrees to 55 degrees;

a one hundredth and eleventh projection angle of 20 degrees, said one hundredth and eleventh projection angle having said diagonal head shape category with said 2-inch guide length, and said tenth fall angle ranging from 30 degrees to 40 degrees;

a one hundredth and twelfth projection angle of 30 degrees, said one hundredth and twelfth projection angle having said diagonal head shape category with said 3-inch guide length, and said tenth fall angle ranging from 30 degrees to 40 degrees;

a one hundredth and thirteenth projection angle of 40 degrees, said one hundredth and thirteenth projection angle having said diagonal head shape category with said 4-inch guide length, and said tenth fall angle ranging from 30 degrees to 40 degrees;

a one hundredth and fourteenth projection angle of 50 degrees, said one hundredth and fourteenth projection angle having said diagonal head shape category with said 5-inch guide length, and said tenth fall angle ranging from 30 degrees to 40 degrees;

a one hundredth and fifteenth projection angle of 60 degrees, said one hundredth and fifteenth projection angle having said diagonal head shape category with said 6-inch guide length, and said tenth fall angle ranging from 30 degrees to 40 degrees;

a one hundredth and sixteenth projection angle of at least 135 degrees, said one hundredth and sixteenth projection angle having said diagonal vertical head shape category with said 2-inch guide length, and said third fall angle ranging from 140 degrees to 155 degrees;

a one hundredth and seventeenth projection angle of 115 degrees, said one hundredth and seventeenth projection angle having said diagonal vertical head shape category with said 2-inch guide length, and said fourth fall angle ranging from 120 degrees to 135 degrees;

a one hundredth and eighteenth projection angle of 125 degrees, said one hundredth and eighteenth projection angle having said diagonal vertical head shape category with said 3-inch guide length, and said fourth fall angle ranging from 120 degrees to 135 degrees;

a one hundredth and nineteenth projection angle of at least 135 degrees, said one hundredth and nineteenth projection angle having said diagonal vertical head shape category with said 4-inch guide length, and said fourth fall angle ranging from 120 degrees to 135 degrees;

a one hundredth and twentieth projection angle of 105 degrees, said one hundredth and twentieth projection angle having said diagonal vertical head shape category with said 2-inch guide length, and said fifth fall angle ranging from 95 degrees to 115 degrees;

a one hundredth and twenty-first projection angle of 115 degrees, said one hundredth and twenty-first projection angle having said diagonal vertical head shape category with said 3-inch guide length, and said fifth fall angle ranging from 95 degrees to 115 degrees;

a one hundredth and twenty-second projection angle of 125 degrees, said one hundredth and twenty-second projection angle having said diagonal vertical head shape category with said 4-inch guide length, and said fifth fall angle ranging from 95 degrees to 115 degrees;

a one hundredth and twenty-third projection angle of at least 135 degrees, said one hundredth and twenty-third projection angle having said diagonal vertical head shape category with said 5-inch guide length, and said fifth fall angle ranging from 95 degrees to 115 degrees;

a one hundredth and twenty-fourth projection angle of 100 degrees, said one hundredth and twenty-fourth projection angle having said diagonal vertical head shape category with said 2-inch guide length, and said sixth fall angle of 90 degrees;

a one hundredth and twenty-fifth projection angle of 110 degrees, said one hundredth and twenty-fifth projection angle having said diagonal vertical head shape category with said 3-inch guide length, and said sixth fall angle of 90 degrees;

a one hundredth and twenty-sixth projection angle of 120 degrees, said one hundredth and twenty-sixth projection angle having said diagonal vertical head shape category with said 4-inch guide length, and said sixth fall angle of 90 degrees;

a one hundredth and twenty-seventh projection angle of 130 degrees, said one hundredth and twenty-seventh projection angle having said diagonal vertical head shape category with said 5-inch guide length, and said sixth fall angle of 90 degrees;

a one hundredth and twenty-eighth projection angle of at least 135 degrees, said one hundredth and twenty-eighth projection angle having said diagonal vertical head shape category with said 6-inch guide length, and said sixth fall angle of 90 degrees;

a one hundredth and twenty-ninth projection angle of 75 degrees, said one hundredth and twenty-ninth projection angle having said diagonal vertical head shape category with said 2-inch guide length, and said seventh fall angle ranging from 75 degrees to 85 degrees;

a one hundred thirtieth projection angle of 85 degrees, said one hundred thirtieth projection angle having said diagonal vertical head shape category with said 3-inch guide length, and said seventh fall angle ranging from 75 degrees to 85 degrees;

a one hundred thirty-first projection angle of 95 degrees, said one hundred thirty-first projection angle having said diagonal vertical head shape category with said 4-inch guide length, and said seventh fall angle ranging from 75 degrees to 85 degrees;

a one hundred thirty-second projection angle of 105 degrees, said one hundred thirty-second projection angle having said diagonal vertical head shape category with said 5-inch guide length, and said seventh fall angle ranging from 75 degrees to 85 degrees;

a one hundred thirty-third projection angle of 110 degrees, said one hundred thirty-third projection angle having said diagonal vertical head shape category with said 6-inch guide length, and said seventh fall angle ranging from 75 degrees to 85 degrees;

a one hundred thirty-fourth projection angle of 55 degrees, said one hundred thirty-fourth projection angle having said diagonal vertical head shape category with said 2-inch guide length, and said eighth fall angle ranging from 60 degrees to 70 degrees;

a one hundred thirty-fifth projection angle of 65 degrees, said one hundred thirty-fifth projection angle having said diagonal vertical head shape category with said 3-inch guide length, and said eighth fall angle ranging from 60 degrees to 70 degrees;

a one hundred thirty-sixth projection angle of 75 degrees, said one hundred thirty-sixth projection angle having said diagonal vertical head shape category with said 4-inch guide length, and said eighth fall angle ranging from 60 degrees to 70 degrees;

a one hundred thirty-seventh projection angle of 85 degrees, said one hundred thirty-seventh projection angle having said diagonal vertical head shape category with said 5-inch guide length, and said eighth fall angle ranging from 60 degrees to 70 degrees;

a one hundred thirty-eighth projection angle of 90 degrees, said one hundred thirty-eighth projection angle having said diagonal vertical head shape category with said 6-inch guide length, and said eighth fall angle ranging from 60 degrees to 70 degrees;

a one hundred thirty-ninth projection angle of 40 degrees, said one hundred thirty-ninth projection angle having said diagonal vertical head shape category with said 2-inch guide length, and said ninth fall angle ranging from 45 degrees to 55 degrees;

a one hundred fortieth projection angle of 50 degrees, said one hundred fortieth projection angle having said diagonal vertical head shape category with said 3-inch guide length, and said ninth fall angle ranging from 45 degrees to 55 degrees;

a one hundred forty-first projection angle of 60 degrees, said one hundred forty-first projection angle having said diagonal vertical head shape category with said 4-inch guide length, and said ninth fall angle ranging from 45 degrees to 55 degrees;

a one hundred forty-second projection angle of 65 degrees, said one hundred forty-second projection angle having said diagonal vertical head shape category with said 5-inch guide length, and said ninth fall angle ranging from 45 degrees to 55 degrees;

a one hundred forty-third projection angle of 70 degrees, said one hundred forty-third projection angle having said diagonal vertical head shape category with said 6-inch guide length, and said ninth fall angle ranging from 45 degrees to 55 degrees;

a one hundred forty-fourth projection angle of 35 degrees, said one hundred forty-fourth projection angle having said diagonal vertical head shape category with said 2-inch guide length, and said tenth fall angle ranging from 30 degrees to 40 degrees;

a one hundred forty-fifth projection angle of 40 degrees, said one hundred forty-fifth projection angle having said diagonal vertical head shape category with said 3-inch guide length, and said tenth fall angle ranging from 30 degrees to 40 degrees;

a one hundred forty-sixth projection angle of 45 degrees, said one hundred forty-sixth projection angle having said diagonal vertical head shape category with said 4-inch guide length, and said tenth fall angle ranging from 30 degrees to 40 degrees;

a one hundred forty-seventh projection angle of 55 degrees, said one hundred forty-seventh projection angle having said diagonal vertical head shape category with said 5-inch guide length, and said tenth fall angle ranging from 30 degrees to 40 degrees;

a one hundred forty-eighth projection angle of 60 degrees, said one hundred forty-eighth projection angle having said diagonal vertical head shape category with said 6-inch guide length, and said tenth fall angle ranging from 30 degrees to 40 degrees;

a one hundred forty-ninth projection angle of at least 135 degrees, said one hundred forty-ninth projection angle having said vertical head shape category with said 2-inch guide length, and said fifth fall angle ranging from 95 degrees to 115 degrees;

a one hundred fiftieth projection angle of at least 125 degrees, said one hundred fiftieth projection angle having said vertical head shape category with said 2-inch guide length, and said sixth fall angle of 90 degrees;

a one hundred fifty-first projection angle of 130 degrees, said one hundred fifty-first projection angle having said vertical head shape category with said 3-inch guide length, and said sixth fall angle of 90 degrees;

a one hundred fifty-second projection angle of at least 135 degrees, said one hundred fifty-second projection angle having said vertical head shape category with said 4-inch guide length, and said sixth fall angle of 90 degrees;

a one hundred fifty-third projection angle of at least 135 degrees, said one hundred fifty-third projection angle having said vertical head shape category with said 5-inch guide length, and said sixth fall angle of 90 degrees;

a one hundred fifty-fourth projection angle of at least 135 degrees, said one hundred fifty-fourth projection angle having said vertical head shape category with said 6-inch guide length, and said sixth fall angle of 90 degrees;

a one hundred fifty-fifth projection angle of 100 degrees, said one hundred fifty-fifth projection angle having said vertical head shape category with said 2-inch guide length, and said seventh fall angle ranging from 75 degrees to 85 degrees;

a one hundred fifty-sixth projection angle of 105 degrees, said one hundred fifty-sixth projection angle having said vertical head shape category with said 3-inch guide length, and said seventh fall angle ranging from 75 degrees to 85 degrees;

a one hundred fifty-seventh projection angle of 110 degrees, said one hundred fifty-seventh projection angle having said vertical head shape category with said 4-inch guide length, and said seventh fall angle ranging from 75 degrees to 85 degrees;

a one hundred fifty-eighth projection angle of 110 degrees, said one hundred fifty-eighth projection angle having said vertical head shape category with said 5-inch guide length, and said seventh fall angle ranging from 75 degrees to 85 degrees;

a one hundred fifty-ninth projection angle of 110 degrees, said one hundred fifty-eighth projection angle having said vertical head shape category with said 6-inch guide length, and said seventh fall angle ranging from 75 degrees to 85 degrees;

a one hundred sixtieth projection angle of 80 degrees, said one hundred sixtieth projection angle having said vertical head shape category with said 2-inch guide length, and said eighth fall angle ranging from 60 degrees to 70 degrees;

a one hundred sixty-first projection angle of 85 degrees, said one hundred sixty-first projection angle having said vertical head shape category with said 3-inch guide length, and said eighth fall angle ranging from 60 degrees to 70 degrees;

a one hundred sixty-second projection angle of 90 degrees, said one hundred sixty-second projection angle having said vertical head shape category with said 4-inch guide length, and said eighth fall angle ranging from 60 degrees to 70 degrees;

a one hundred sixty-third projection angle of 90 degrees, said one hundred sixty-third projection angle having said vertical head shape category with said 5-inch guide length, and said eighth fall angle ranging from 60 degrees to 70 degrees;

a one hundred sixty-fourth projection angle of 90 degrees, said one hundred sixty-fourth projection angle having said vertical head shape category with said 6-inch guide length, and said eighth fall angle ranging from 60 degrees to 70 degrees;

a one hundred sixty-fifth projection angle of 60 degrees, said one hundred sixty-fifth projection angle having said vertical head shape category with said 2-inch guide length, and said ninth fall angle ranging from 45 degrees to 55 degrees;

a one hundred sixty-sixth projection angle of 65 degrees, said one hundred sixty-sixth projection angle having said vertical head shape category with said 3-inch guide length, and said ninth fall angle ranging from 45 degrees to 55 degrees;

a one hundred sixty-seventh projection angle of 70 degrees, said one hundred sixty-seventh projection angle having said vertical head shape category with said 4-inch guide length, and said ninth fall angle ranging from 45 degrees to 55 degrees;

a one hundred sixty-eighth projection angle of 70 degrees, said one hundred sixty-eighth projection angle having said vertical head shape category with said 5-inch guide length, and said ninth fall angle ranging from 45 degrees to 55 degrees;

a one hundred sixty-ninth projection angle of 70 degrees, said one hundred sixty-ninth projection angle having said vertical head shape category with said 6-inch guide length, and said ninth fall angle ranging from 45 degrees to 55 degrees;

a one hundred seventieth projection angle of 50 degrees, said one hundred seventieth projection angle having said vertical head shape category with said 2-inch guide length, and said tenth fall angle ranging from 30 degrees to 40 degrees;

a one hundred seventy-first projection angle of 55 degrees, said one hundred seventy-first projection angle having said vertical head shape category with said 3-inch guide length, and said tenth fall angle ranging from 30 degrees to 40 degrees;

a one hundred seventy-second projection angle of 60 degrees, said one hundred seventy-second projection angle having said vertical head shape category with said 4-inch guide length, and said tenth fall angle ranging from 30 degrees to 40 degrees;

a one hundred seventy-third projection angle of 60 degrees, said one hundred seventy-third projection angle having said vertical head shape category with said 5-inch guide length, and said tenth fall angle ranging from 30 degrees to 40 degrees; and a one hundred seventy-fourth projection angle of 60 degrees, said one hundred seventy-fourth projection angle having said vertical head shape category with said 6-inch guide length, and said tenth fall angle ranging from 30 degrees to 40 degrees.

13. A method for cutting hair resulting in the transformation of said hair into a haircut style using a projection chart to determine a plurality of projection angles by which to cut the hair comprising the steps of:

a hairstylist evaluating a client, the client having a head, said head having a top with a crown and a part, a front side, a left side, a right side, and a back side, each side comprising one or more slopes as determined when traversing downward from the top of the head; a scalp covering said head; a plurality of hair emanating from said scalp, said hair having a plurality of densities and volumes; a front hairline, a left side hairline, a right side hair line, and a back hairline;

the client choosing the haircut style, said haircut style having a haircut shape;

the hairstylist determining a location on the client's scalp for each of a plurality of quadrants, wherein each quadrant comprising a plurality of head shape categories; said plurality of quadrants comprising a front quadrant, said front quadrant extending upwards from the front hairline to the top of the head; a left side quadrant, said left side quadrant extending upwards from the left side hairline to the top side of the head; a right side quadrant, said right side quadrant extending upwards from the right side hairline to the top side of the head; and a back quadrant, said back quadrant extending upwards from the back hairline to the top of the head, said back quadrant further comprising a left back quadrant, a center back quadrant, and a right back quadrant; wherein the plurality of said quadrants converge at the crown of the client's head;

the hairstylist determining and cutting a plurality of guide lengths for the haircut shape, each quadrant having a guide length comprising a top portion of the hair within said quadrant, said top portion of hair running horizontally within the quadrant said guide lengths comprising 2 inches, 3 inches, 4 inches, 5 inches, and 6 inches;

the hairstylist determining and cutting one or more perimeter lines having a desired length and a density, wherein said perimeter line comprising the hair at the bottom of the hairstyle for each of the quadrants, wherein said density comprising the volume of hair of hair present at the perimeter line;

the hairstylist determining one or more fall angles for said haircut shape, said fall angles being located in one or more of said quadrants, said fall angle being the manner in which the hair is distributed when said hair is in a natural fall produced by gravity, the natural fall being the position in which said hair rests;

the hairstylist determining a plurality of numerically sequential adjoining planes for each of the quadrants, each plane comprising a slope as determined when traversing downward from the top of the head; a first plane beginning at the top of the client's head, said plane having a first slope; each subsequent plane begins with each change in the slope within said quadrant; said plurality of numerically sequential adjoining planes being likewise identified as sequentially numbered adjoining levels, each level comprising the same number and slope as its corresponding plane;

wherein a plane having a slope ranging from 180 degrees to 160 degrees is designated as a horizontal head shape category; wherein a plane having a slope ranging from 159 degrees to 140 degrees is designated as a diagonal horizontal head shape category; wherein a plane having a slope ranging from 139 degrees to 120 degrees is designated as a diagonal head shape category; wherein a plane having a slope ranging from 119 degrees to 110 degrees is designated as a diagonal vertical head shape category; wherein a plane having a slope ranging from 99 degrees to 80 degrees is designated as a vertical head shape category; wherein a plane having a slope less than 80 degrees is designated as a diagonal down head shape category;

the hairstylist determining the plurality of projection angles for each quadrant with the projection chart, wherein the hairstylist inputs the fall angle, the head shape category, and the guide length values into the projection chart for each plane of a client's head;

the hairstylist cutting said hair at the projection angle as provided by the projection chart for each plane identified on the client's head, said projection chart comprising a first projection angle of 115 degrees, said first projection angle having said horizontal head shape category with said 2-inch guide length, and a first fall angle of 180 degrees;

a second projection angle of at least 135 degrees, said second projection angle having said horizontal head shape category with said 3-inch guide length, and said first fall angle of 180 degrees;

a third projection angle of 90 degrees, said third projection angle having said horizontal head shape category with said 2-inch guide length, and a second fall angle ranging from 160 degrees to 175 degrees;

a fourth projection angle of 110 degrees, said fourth projection angle having said horizontal head shape category with said 3-inch guide length, and said second fall angle ranging from 160 degrees to 175 degrees;

a fifth projection angle of at least 130 degrees, said fifth projection angle having said horizontal head shape category with said 4-inch guide length, and said second fall angle ranging from 160 degrees to 175 degrees;

a six projection angle of 75 degrees, said six projection angle having said horizontal head shape category with said 2-inch guide length, and a third fall angle ranging from 140 degrees to 155 degrees;

a seventh projection angle of 90 degrees, said seventh projection angle having said horizontal head shape category with said 3-inch guide length, and said third fall angle ranging from 140 degrees to 155 degrees;

an eighth projection angle of 110 degrees, said eighth projection angle having said horizontal head shape category with said 4-inch guide length, and said third fall angle ranging from 140 degrees to 155 degrees;

a ninth projection angle at least 135 degrees, said ninth projection angle having said horizontal head shape category with said 5-inch guide length, and said third fall angle ranging from 140 degrees to 155 degrees;

a tenth projection angle of 65 degrees, said tenth projection angle having said horizontal head shape category with said 2-inch guide length, and a fourth fall angle ranging from 120 degrees to 135 degrees;

an eleventh projection angle of 80 degrees, said eleventh projection angle having said horizontal head shape category with said 3-inch guide length, and said fourth fall angle ranging from 120 degrees to 135 degrees;

a twelfth projection angle of 105 degrees, said twelfth projection angle having said horizontal head shape category with said 4-inch guide length, and said fourth fall angle ranging from 120 degrees to 135 degrees;

a thirteenth projection angle of at least 130 degrees, said thirteenth projection angle having said horizontal head shape category with said 5-inch guide length, and said fourth fall angle ranging from 120 degrees to 135 degrees;

a fourteenth projection angle of 60 degrees, said fourteenth projection angle having said horizontal head shape category with said 2-inch guide length, and a fifth fall angle ranging from 95 degrees to 115 degrees;

a fifteenth projection angle of 70 degrees, said fifteenth projection angle having said horizontal head shape category with said 3-inch guide length, and said fifth fall angle ranging from 95 degrees to 115 degrees;

a sixteenth projection angle of 100 degrees, said sixteen projection angle having said horizontal head shape category with said 4-inch guide length, and said fifth fall angle ranging from 95 degrees to 115 degrees;

a seventeenth projection angle of 120 degrees, said seventeenth projection angle having said horizontal head shape category with said 5-inch guide length, and said fifth fall angle ranging from 95 degrees to 115 degrees;

an eighteenth projection angle of at least 140 degrees, said eighteenth projection angle having said horizontal head shape category with said 6-inch guide length, and said fifth fall angle ranging from 95 degrees to 115 degrees;

a nineteenth projection angle of 60 degrees, said nineteenth projection angle having said horizontal head shape category with said 3-inch guide length, and a sixth fall angle of 90 degrees;

a twentieth projection angle of 95 degrees, said twentieth projection angle having said horizontal head shape category with said 4-inch guide length, and said sixth fall angle of 90 degrees;

a twenty-first projection angle of 110 degrees, said twenty first projection angle having said horizontal head shape category with said 5-inch guide length, and said sixth fall angle of 90 degrees;

a twenty-second projection angle of at least 135 degrees, said twenty second projection angle having said horizontal head shape category with said 6-inch guide length, and said sixth fall angle of 90 degrees;

a twenty-third projection angle of 40 degrees, said twenty third projection angle having said horizontal head shape category with said 3-inch guide length, and a seventh fall angle ranging from 75 degrees to 85 degrees;

a twenty-fourth projection angle of 65 degrees, said twenty fourth projection angle having said horizontal head shape category with said 4-inch guide length, and said seventh fall angle ranging from 75 degrees to 85 degrees;

a twenty-fifth projection angle of 90 degrees, said twenty fifth projection angle having said horizontal head shape category with said 5-inch guide length, and said seventh fall angle ranging from 75 degrees to 85 degrees;

a twenty-sixth projection angle of 110 degrees, said twenty sixth projection angle having said horizontal head shape category with said 6-inch guide length, and said seventh fall angle ranging from 75 degrees to 85 degrees;

a twenty-seventh projection angle of 30 degrees, said twenty seventh projection angle having said horizontal head shape category with said 3-inch guide length, and an eighth fall angle ranging from 60 degrees to 70 degrees;

a twenty-eighth projection angle of 50 degrees, said twenty eighth projection angle having said horizontal head shape category with said 4-inch guide length, and said eighth fall angle ranging from 60 degrees to 70 degrees;

a twenty-ninth projection angle of 70 degrees, said twenty ninth projection angle having said horizontal head shape category with said 5-inch guide length, and said eighth fall angle ranging from 60 degrees to 70 degrees;

a thirtieth projection angle of 90 degrees, said thirtieth projection angle having said horizontal head shape category with said 6-inch guide length, and said eighth fall angle ranging from 60 degrees to 70 degrees;

a thirty-first projection angle of 15 degrees, said thirty first projection angle having said horizontal head shape category with said 3-inch guide length, and a ninth fall angle ranging from 45 degrees to 55 degrees;

a thirty-second projection angle of 30 degrees, said thirty second projection angle having said horizontal head shape category with said 4-inch guide length, and said ninth fall angle ranging from 45 degrees to 55 degrees;

a thirty-third projection angle of 50 degrees, said thirty third projection angle having said horizontal head shape category with said 5-inch guide length, and said ninth fall angle ranging from 45 degrees to 55 degrees;

a thirty-fourth projection angle of 70 degrees, said thirty fourth projection angle having said horizontal head shape category with said 6-inch guide length, and said ninth fall angle ranging from 45 degrees to 55 degrees;

a thirty-fifth projection angle of 0 degrees, said thirty fifth projection angle having said horizontal head shape category with said 3-inch guide length, and a tenth fall angle ranging from 30 degrees to 40 degrees;

a thirty-sixth projection angle of 20 degrees, said thirty sixth projection angle having said horizontal head shape category with said 4-inch guide length, and said tenth fall angle ranging from 30 degrees to 40 degrees;

a thirty-seventh projection angle of 40 degrees, said thirty seventh projection angle having said horizontal head shape category with said 5-inch guide length, and said tenth fall angle ranging from 30 degrees to 40 degrees;

a thirty-eighth projection angle of 60 degrees, said thirty eighth projection angle having said horizontal head shape category with said 6-inch guide length, and said tenth fall angle ranging from 30 degrees to 40 degrees;

a thirty-ninth projection angle of at least 135 degrees, said thirty ninth projection angle having said diagonal horizontal head shape category with said 2-inch guide length, and said first fall angle of 180 degrees;

a fortieth projection angle of 110 degrees, said fortieth projection angle having said diagonal horizontal head shape category with said 2-inch guide length, and said second fall angle ranging from 160 degrees to 175 degrees;

a forty-first projection angle of at least 130 degrees, said forty first projection angle having said diagonal horizontal head shape category with said 3-inch guide length, and said second fall angle ranging from 160 degrees to 175 degrees;

a forty-second projection angle of 95 degrees, said forty second projection angle having said diagonal horizontal head shape category with said 2-inch guide length, and said third fall angle ranging from 140 degrees to 155 degrees;

a forty-third projection angle of 115 degrees, said forty third projection angle having said diagonal horizontal head shape category with said 3-inch guide length, and said third fall angle ranging from 140 degrees to 155 degrees;

a forty-fourth projection angle of at least 130 degrees, said forty fourth projection angle having said diagonal horizontal head shape category with said 4-inch guide length, and said third fall angle ranging from 140 degrees to 155 degrees;

a forty-fifth projection angle of 90 degrees, said forty fifth projection angle having said diagonal horizontal head shape category with said 2-inch guide length, and said fourth fall angle ranging from 120 degrees to 135 degrees;

a forty-sixth projection angle of 105 degrees, said forty sixth projection angle having said diagonal horizontal head shape category with said 3-inch guide length, and said fourth fall angle ranging from 120 degrees to 135 degrees;

a forty-seventh projection angle of 120 degrees, said forty seventh projection angle having said diagonal horizontal head shape category with said 4-inch guide length, and said fourth fall angle ranging from 120 degrees to 135 degrees;

a forty-eighth projection angle of at least 135 degrees, said forty eighth projection angle having said diagonal horizontal head shape category with said 5-inch guide length, and said fourth fall angle ranging from 120 degrees to 135 degrees;

a forty-ninth projection angle of 80 degrees, said forty ninth projection angle having said diagonal horizontal head shape category with said 2-inch guide length, and said fifth fall angle ranging from 95 degrees to 115 degrees;

a fiftieth projection angle of 95 degrees, said fiftieth projection angle having said diagonal horizontal head shape category with said 3-inch guide length, and said fifth fall angle ranging from 95 degrees to 115 degrees;

a fifty-first projection angle of 110 degrees, said fifty first projection angle having said diagonal horizontal head shape category with said 4-inch guide length, and said fifth fall angle ranging from 95 degrees to 115 degrees;

a fifty-second projection angle of 125 degrees, said fifty second projection angle having said diagonal horizontal head shape category with said 5-inch guide length, and said fifth fall angle ranging from 95 degrees to 115 degrees;

a fifty-third projection angle of at least 140 degrees, said fifty third projection angle having said diagonal horizontal head shape category with said 6-inch guide length, and said fifth fall angle ranging from 95 degrees to 115 degrees;

a fifty-fourth projection angle of 75 degrees, said fifty fourth projection angle having said diagonal horizontal head shape category with said 2-inch guide length, and said sixth fall angle of 90 degrees;

a fifty-fifth projection angle of 90 degrees, said fifty fifth projection angle having said diagonal horizontal head shape category with said 3-inch guide length, and said sixth fall angle of 90 degrees;

a fifty-sixth projection angle of 105 degrees, said fifty sixth projection angle having said diagonal horizontal head shape category with said 4-inch guide length, and said sixth fall angle of 90 degrees;

a fifty-seventh projection angle of 120 degrees, said fifty seventh projection angle having said diagonal horizontal head shape category with said 5-inch guide length, and said sixth fall angle of 90 degrees;

a fifty-eighth projection angle of at least 135 degrees, said fifty eighth projection angle having said diagonal horizontal head shape category with said 6-inch guide length, and said sixth fall angle of 90 degrees;

a fifty-ninth projection angle of 40 degrees, said fifty ninth projection angle having said diagonal horizontal head shape category with said 2-inch guide length, and said seventh fall angle ranging from 75 degrees to 85 degrees;

a sixtieth projection angle of 55 degrees, said sixtieth projection angle having said diagonal horizontal head shape category with said 3-inch guide length, and said seventh fall angle ranging from 75 degrees to 85 degrees;

a sixty-first projection angle of 70 degrees, said sixty first projection angle having said diagonal horizontal head shape category with said 4-inch guide length, and said seventh fall angle ranging from 75 degrees to 85 degrees;

a sixty-second projection angle of 95 degrees, said sixty second projection angle having said diagonal horizontal head shape category with said 5-inch guide length, and said seventh fall angle ranging from 75 degrees to 85 degrees;

a sixty-third projection angle of 110 degrees, said sixty third projection angle having said diagonal horizontal head shape category with said 6-inch guide length, and said seventh fall angle ranging from 75 degrees to 85 degrees;

a sixty-fourth projection angle of 30 degrees, said sixty fourth projection angle having said diagonal horizontal head shape category with said 2-inch guide length, and said eighth fall angle ranging from 60 degrees to 70 degrees;

a sixty-fifth projection angle of 45 degrees, said sixty fifth projection angle having said diagonal horizontal head shape category with said 3-inch guide length, and said eighth fall angle ranging from 60 degrees to 70 degrees;

a sixty-sixth projection angle of 60 degrees, said sixty sixth projection angle having said diagonal horizontal head shape category with said 4-inch guide length, and said eighth fall angle ranging from 60 degrees to 70 degrees;

a sixty-seventh projection angle of 75 degrees, said sixty seventh projection angle having said diagonal horizontal head shape category with said 5-inch guide length, and said eighth fall angle ranging from 60 degrees to 70 degrees;

a sixty-eighth projection angle of 90 degrees, said sixty eighth projection angle having said diagonal horizontal head shape category with said 6-inch guide length, and said eighth fall angle ranging from 60 degrees to 70 degrees;

a sixty-ninth projection angle of 10 degrees, said sixty ninth projection angle having said diagonal horizontal head shape category with said 2-inch guide length, and said ninth fall angle ranging from 45 degrees to 55 degrees;

a seventieth projection angle of 25 degrees, said seventieth projection angle having said diagonal horizontal head shape category with said 3-inch guide length, and said ninth fall angle ranging from 45 degrees to 55 degrees;

a seventy-first projection angle of 40 degrees, said seventy first projection angle having said diagonal horizontal head shape category with said 4-inch guide length, and said ninth fall angle ranging from 45 degrees to 55 degrees;

a seventy-second projection angle of 55 degrees, said seventy second projection angle having said diagonal horizontal head shape category with said 5-inch guide length, and said ninth fall angle ranging from 45 degrees to 55 degrees;

a seventy-third projection angle of 70 degrees, said seventy third projection angle having said diagonal horizontal head shape category with said 6-inch guide length, and said ninth fall angle ranging from 45 degrees to 55 degrees;

a seventy-fourth projection angle of 0 degrees, said seventy fourth projection angle having said diagonal horizontal head shape category with said 2-inch guide length, and said tenth fall angle ranging from 30 degrees to 40 degrees;

a seventy-fifth projection angle of 15 degrees, said seventy fifth projection angle having said diagonal horizontal head shape category with said 3-inch guide length, and said tenth fall angle ranging from 30 degrees to 40 degrees;

a seventy-sixth projection angle of 30 degrees, said seventy sixth projection angle having said diagonal horizontal head shape category with said 4-inch guide length, and said tenth fall angle ranging from 30 degrees to 40 degrees;

a seventy-seventh projection angle of 45 degrees, said seventy seventh projection angle having said diagonal horizontal head shape category with said 5-inch guide length, and said tenth fall angle ranging from 30 degrees to 40 degrees;

a seventy-eighth projection angle of 60 degrees, said seventy eighth projection angle having said diagonal horizontal head shape category with said 6-inch guide length, and said tenth fall angle ranging from 30 degrees to 40 degrees;

a seventy-ninth projection angle of at least 135 degrees, said seventy ninth projection angle having said diagonal head shape category with said 2-inch guide length, and said second fall angle ranging from 160 degrees to 175 degrees;

an eightieth projection angle of 115 degrees, said eightieth projection angle having said diagonal head shape category with said 2-inch guide length, and said third fall angle ranging from 140 degrees to 155 degrees;

an eighty-first projection angle of at least 130 degrees, said eighty-first projection angle having said diagonal head shape category with said 3-inch guide length, and said third fall angle ranging from 140 degrees to 155 degrees;

an eighty-second projection angle of 105 degrees, said eighty-second projection angle having said diagonal head shape category with said 2-inch guide length, and said fourth fall angle ranging from 120 degrees to 135 degrees;

an eighty-third projection angle of 120 degrees, said eighty-third projection angle having said diagonal head shape category with said 3-inch guide length, and said fourth fall angle ranging from 120 degrees to 135 degrees;

an eighty-fourth projection angle of 130 degrees, said eighty-fourth projection angle having said diagonal head shape category with said 4-inch guide length, and said fourth fall angle ranging from 120 degrees to 135 degrees;

an eighty-fifth projection angle of at least 140 degrees, said eighty-fifth projection angle having said diagonal head shape category with said 5-inch guide length, and said fourth fall angle ranging from 120 degrees to 135 degrees;

an eighty-sixth projection angle of 100 degrees, said eighty-sixth projection angle having said diagonal head shape category with said 2-inch guide length, and said fifth fall angle ranging from 95 degrees to 115 degrees;

an eighty-seventh projection angle of 110 degrees, said eighty-seventy projection angle having said diagonal head shape category with said 3-inch guide length, and said fifth fall angle ranging from 95 degrees to 115 degrees;

an eighty-eighth projection angle of 120 degrees, said eighty-eighth projection angle having said diagonal head shape category with said 4-inch guide length, and said fifth fall angle ranging from 95 degrees to 115 degrees;

an eighty-ninth projection angle of 130 degrees, said eighty-ninth projection angle having said diagonal head shape category with said 5-inch guide length, and said fifth fall angle ranging from 95 degrees to 115 degrees;

a ninetieth projection angle of at least 140 degrees, said ninetieth projection angle having said diagonal head shape category with said 6-inch guide length, and said fifth fall angle ranging from 95 degrees to 115 degrees;

a ninety-first projection angle of 90 degrees, said ninety-first projection angle having said diagonal head shape category with said 2-inch guide length, and said sixth fall angle of 90 degrees;

a ninety-second projection angle of 100 degrees, said ninety-second projection angle having said diagonal head shape category with said 3-inch guide length, and said sixth fall angle of 90 degrees;

a ninety-third projection angle of 115 degrees, said ninety-third projection angle having said diagonal head shape category with said 4-inch guide length, and said sixth fall angle of 90 degrees;

a ninety-fourth projection angle of 125 degrees, said ninety-fourth projection angle having said diagonal head shape category with said 5-inch guide length, and said sixth fall angle of 90 degrees;

a ninety-fifth projection angle of at least 135 degrees, said ninety-fifth projection angle having said diagonal head shape category with said 6-inch guide length, and said sixth fall angle of 90 degrees;

a ninety-sixth projection angle of 70 degrees, said ninety-sixth projection angle having said diagonal head shape category with said 2-inch guide length, and said seventh fall angle ranging from 75 degrees to 85 degrees;

a ninety-seventh projection angle of 80 degrees, said ninety-seventh projection angle having said diagonal head shape category with said 3-inch guide length, and said seventh fall angle ranging from 75 degrees to 85 degrees;

a ninety-eighth projection angle of 90 degrees, said ninety-eighth projection angle having said diagonal head shape category with said 4-inch guide length, and said seventh fall angle ranging from 75 degrees to 85 degrees;

a ninety-ninth projection angle of 100 degrees, said ninety-ninth projection angle having said diagonal head shape category with said 5-inch guide length, and said seventh fall angle ranging from 75 degrees to 85 degrees;

a one hundredth projection angle of 110 degrees, said one hundredth projection angle having said diagonal head shape category with said 6-inch guide length, and said seventh fall angle ranging from 75 degrees to 85 degrees;

a one hundredth and first projection angle of 50 degrees, said one hundredth and first projection angle having said diagonal head shape category with said 2-inch guide length, and said eighth fall angle ranging from 60 degrees to 70 degrees;

a one hundredth and second projection angle of 60 degrees, said one hundredth and second projection angle having said diagonal head shape category with said 3-inch guide length, and said eighth fall angle ranging from 60 degrees to 70 degrees;

a one hundredth and third projection angle of 70 degrees, said one hundredth and third projection angle having said diagonal head shape category with said 4-inch guide length, and said eighth fall angle ranging from 60 degrees to 70 degrees;

a one hundredth and fourth projection angle of 80 degrees, said one hundredth and fourth projection angle having said diagonal head shape category with said 5-inch guide length, and said eighth fall angle ranging from 60 degrees to 70 degrees;

a one hundredth and fifth projection angle of 90 degrees, said one hundredth and fifth projection angle having said diagonal head shape category with said 6-inch guide length, and said eighth fall angle ranging from 60 degrees to 70 degrees;

a one hundredth and sixth projection angle of 30 degrees, said one hundredth and sixth projection angle having said diagonal head shape category with said 2-inch guide length, and said ninth fall angle ranging from 45 degrees to 55 degrees;

a one hundredth and seventh projection angle of 40 degrees, said one hundredth and seventh projection angle having said diagonal head shape category with said 3-inch guide length, and said ninth fall angle ranging from 45 degrees to 55 degrees;

a one hundredth and eighth projection angle of 50 degrees, said one hundredth and eighth projection angle having said diagonal head shape category with said 4-inch guide length, and said ninth fall angle ranging from 45 degrees to 55 degrees;

a one hundredth and ninth projection angle of 60 degrees, said one hundredth and ninth projection angle having said diagonal head shape category with said 5-inch guide length, and said ninth fall angle ranging from 45 degrees to 55 degrees;

a one hundredth and tenth projection angle of 70 degrees, said one hundredth and tenth projection angle having said diagonal head shape category with said 6-inch guide length, and said ninth fall angle ranging from 45 degrees to 55 degrees;

a one hundredth and eleventh projection angle of 20 degrees, said one hundredth and eleventh projection angle having said diagonal head shape category with said 2-inch guide length, and said tenth fall angle ranging from 30 degrees to 40 degrees;

a one hundredth and twelfth projection angle of 30 degrees, said one hundredth and twelfth projection angle having said diagonal head shape category with said 3-inch guide length, and said tenth fall angle ranging from 30 degrees to 40 degrees;

a one hundredth and thirteenth projection angle of 40 degrees, said one hundredth and thirteenth projection angle having said diagonal head shape category with said 4-inch guide length, and said tenth fall angle ranging from 30 degrees to 40 degrees;

a one hundredth and fourteenth projection angle of 50 degrees, said one hundredth and fourteenth projection angle having said diagonal head shape category with said 5-inch guide length, and said tenth fall angle ranging from 30 degrees to 40 degrees;

a one hundredth and fifteenth projection angle of 60 degrees, said one hundredth and fifteenth projection angle having said diagonal head shape category with said 6-inch guide length, and said tenth fall angle ranging from 30 degrees to 40 degrees;

a one hundredth and sixteenth projection angle of at least 135 degrees, said one hundredth and sixteenth projection angle having said diagonal vertical head shape category with said 2-inch guide length, and said third fall angle ranging from 140 degrees to 155 degrees;

a one hundredth and seventeenth projection angle of 115 degrees, said one hundredth and seventeenth projection angle having said diagonal vertical head shape category with said 2-inch guide length, and said fourth fall angle ranging from 120 degrees to 135 degrees;

a one hundredth and eighteenth projection angle of 125 degrees, said one hundredth and eighteenth projection angle having said diagonal vertical head shape category with said 3-inch guide length, and said fourth fall angle ranging from 120 degrees to 135 degrees;

a one hundredth and nineteenth projection angle of at least 135 degrees, said one hundredth and nineteenth projection angle having said diagonal vertical head shape category with said 4-inch guide length, and said fourth fall angle ranging from 120 degrees to 135 degrees;

a one hundredth and twentieth projection angle of 105 degrees, said one hundredth and twentieth projection angle having said diagonal vertical head shape category with said 2-inch guide length, and said fifth fall angle ranging from 95 degrees to 115 degrees;

a one hundredth and twenty-first projection angle of 115 degrees, said one hundredth and twenty-first projection angle having said diagonal vertical head shape category with said 3-inch guide length, and said fifth fall angle ranging from 95 degrees to 115 degrees;

a one hundredth and twenty-second projection angle of 125 degrees, said one hundredth and twenty-second projection angle having said diagonal vertical head shape category with said 4-inch guide length, and said fifth fall angle ranging from 95 degrees to 115 degrees;

a one hundredth and twenty-third projection angle of at least 135 degrees, said one hundredth and twenty-third projection angle having said diagonal vertical head shape category with said 5-inch guide length, and said fifth fall angle ranging from 95 degrees to 115 degrees;

a one hundredth and twenty-fourth projection angle of 100 degrees, said one hundredth and twenty-fourth projection angle having said diagonal vertical head shape category with said 2-inch guide length, and said sixth fall angle of 90 degrees;

a one hundredth and twenty-fifth projection angle of 110 degrees, said one hundredth and twenty-fifth projection angle having said diagonal vertical head shape category with said 3-inch guide length, and said sixth fall angle of 90 degrees;

a one hundredth and twenty-sixth projection angle of 120 degrees, said one hundredth and twenty-sixth projection angle having said diagonal vertical head shape category with said 4-inch guide length, and said sixth fall angle of 90 degrees;

a one hundredth and twenty-seventh projection angle of 130 degrees, said one hundredth and twenty-seventh projection angle having said diagonal vertical head shape category with said 5-inch guide length, and said sixth fall angle of 90 degrees;

a one hundredth and twenty-eighth projection angle of at least 135 degrees, said one hundredth and twenty-eighth projection angle having said diagonal vertical head shape category with said 6-inch guide length, and said sixth fall angle of 90 degrees;

a one hundredth and twenty-ninth projection angle of 75 degrees, said one hundredth and twenty-ninth projection angle having said diagonal vertical head shape category with said 2-inch guide length, and said seventh fall angle ranging from 75 degrees to 85 degrees;

a one hundred thirtieth projection angle of 85 degrees, said one hundred thirtieth projection angle having said diagonal vertical head shape category with said 3-inch guide length, and said seventh fall angle ranging from 75 degrees to 85 degrees;

a one hundred thirty-first projection angle of 95 degrees, said one hundred thirty-first projection angle having said diagonal vertical head shape category with said 4-inch guide length, and said seventh fall angle ranging from 75 degrees to 85 degrees;

a one hundred thirty-second projection angle of 105 degrees, said one hundred thirty-second projection angle having said diagonal vertical head shape category with said 5-inch guide length, and said seventh fall angle ranging from 75 degrees to 85 degrees;

a one hundred thirty-third projection angle of 110 degrees, said one hundred thirty-third projection angle having said diagonal vertical head shape category with said 6-inch guide length, and said seventh fall angle ranging from 75 degrees to 85 degrees;

a one hundred thirty-fourth projection angle of 55 degrees, said one hundred thirty-fourth projection angle having said diagonal vertical head shape category with said 2-inch guide length, and said eighth fall angle ranging from 60 degrees to 70 degrees;

a one hundred thirty-fifth projection angle of 65 degrees, said one hundred thirty-fifth projection angle having said diagonal vertical head shape category with said 3-inch guide length, and said eighth fall angle ranging from 60 degrees to 70 degrees;

a one hundred thirty-sixth projection angle of 75 degrees, said one hundred thirty-sixth projection angle having said diagonal vertical head shape category with said 4-inch guide length, and said eighth fall angle ranging from 60 degrees to 70 degrees;

a one hundred thirty-seventh projection angle of 85 degrees, said one hundred thirty-seventh projection angle having said diagonal vertical head shape category with said 5-inch guide length, and said eighth fall angle ranging from 60 degrees to 70 degrees;

a one hundred thirty-eighth projection angle of 90 degrees, said one hundred thirty-eighth projection angle having said diagonal vertical head shape category with said 6-inch guide length, and said eighth fall angle ranging from 60 degrees to 70 degrees;

a one hundred thirty-ninth projection angle of 40 degrees, said one hundred thirty-ninth projection angle having said diagonal vertical head shape category with said 2-inch guide length, and said ninth fall angle ranging from 45 degrees to 55 degrees;

a one hundred fortieth projection angle of 50 degrees, said one hundred fortieth projection angle having said diagonal vertical head shape category with said 3-inch guide length, and said ninth fall angle ranging from 45 degrees to 55 degrees;

a one hundred forty-first projection angle of 60 degrees, said one hundred forty-first projection angle having said diagonal vertical head shape category with said 4-inch guide length, and said ninth fall angle ranging from 45 degrees to 55 degrees;

a one hundred forty-second projection angle of 65 degrees, said one hundred forty-second projection angle having said diagonal vertical head shape category with said 5-inch guide length, and said ninth fall angle ranging from 45 degrees to 55 degrees;

a one hundred forty-third projection angle of 70 degrees, said one hundred forty-third projection angle having said diagonal vertical head shape category with said 6-inch guide length, and said ninth fall angle ranging from 45 degrees to 55 degrees;

a one hundred forty-fourth projection angle of 35 degrees, said one hundred forty-fourth projection angle having said diagonal vertical head shape category with said 2-inch guide length, and said tenth fall angle ranging from 30 degrees to 40 degrees;

a one hundred forty-fifth projection angle of 40 degrees, said one hundred forty-fifth projection angle having said diagonal vertical head shape category with said 3-inch guide length, and said tenth fall angle ranging from 30 degrees to 40 degrees;

a one hundred forty-sixth projection angle of 45 degrees, said one hundred forty-sixth projection angle having said diagonal vertical head shape category with said 4-inch guide length, and said tenth fall angle ranging from 30 degrees to 40 degrees;

a one hundred forty-seventh projection angle of 55 degrees, said one hundred forty-seventh projection angle having said diagonal vertical head shape category with said 5-inch guide length, and said tenth fall angle ranging from 30 degrees to 40 degrees;

a one hundred forty-eighth projection angle of 60 degrees, said one hundred forty-eighth projection angle having said diagonal vertical head shape category with said 6-inch guide length, and said tenth fall angle ranging from 30 degrees to 40 degrees;

a one hundred forty-ninth projection angle of at least 135 degrees, said one hundred forty-ninth projection angle having said vertical head shape category with said 2-inch guide length, and said fifth fall angle ranging from 95 degrees to 115 degrees;

a one hundred fiftieth projection angle of at least 125 degrees, said one hundred fiftieth projection angle having said vertical head shape category with said 2-inch guide length, and said sixth fall angle of 90 degrees;

a one hundred fifty-first projection angle of 130 degrees, said one hundred fifty-first projection angle having said vertical head shape category with said 3-inch guide length, and said sixth fall angle of 90 degrees;

a one hundred fifty-second projection angle of at least 135 degrees, said one hundred fifty-second projection angle having said vertical head shape category with said 4-inch guide length, and said sixth fall angle of 90 degrees;

a one hundred fifty-third projection angle of at least 135 degrees, said one hundred fifty-third projection angle having said vertical head shape category with said 5-inch guide length, and said sixth fall angle of 90 degrees;

a one hundred fifty-fourth projection angle of at least 135 degrees, said one hundred fifty-fourth projection angle having said vertical head shape category with said 6-inch guide length, and said sixth fall angle of 90 degrees;

a one hundred fifty-fifth projection angle of 100 degrees, said one hundred fifty-fifth projection angle having said vertical head shape category with said 2-inch guide length, and said seventh fall angle ranging from 75 degrees to 85 degrees;

a one hundred fifty-sixth projection angle of 105 degrees, said one hundred fifty-sixth projection angle having said vertical head shape category with said 3-inch guide length, and said seventh fall angle ranging from 75 degrees to 85 degrees;

a one hundred fifty-seventh projection angle of 110 degrees, said one hundred fifty-seventh projection angle having said vertical head shape category with said 4-inch guide length, and said seventh fall angle ranging from 75 degrees to 85 degrees;

a one hundred fifty-eighth projection angle of 110 degrees, said one hundred fifty-eighth projection angle having said vertical head shape category with said 5-inch guide length, and said seventh fall angle ranging from 75 degrees to 85 degrees;

a one hundred fifty-ninth projection angle of 110 degrees, said one hundred fifty-eighth projection angle having said vertical head shape category with said 6-inch guide length, and said seventh fall angle ranging from 75 degrees to 85 degrees;

a one hundred sixtieth projection angle of 80 degrees, said one hundred sixtieth projection angle having said vertical head shape category with said 2-inch guide length, and said eighth fall angle ranging from 60 degrees to 70 degrees;

a one hundred sixty-first projection angle of 85 degrees, said one hundred sixty-first projection angle having said vertical head shape category with said 3-inch guide length, and said eighth fall angle ranging from 60 degrees to 70 degrees;

a one hundred sixty-second projection angle of 90 degrees, said one hundred sixty-second projection angle having said vertical head shape category with said 4-inch guide length, and said eighth fall angle ranging from 60 degrees to 70 degrees;

a one hundred sixty-third projection angle of 90 degrees, said one hundred sixty-third projection angle having said vertical head shape category with said 5-inch guide length, and said eighth fall angle ranging from 60 degrees to 70 degrees;

a one hundred sixty-fourth projection angle of 90 degrees, said one hundred sixty-fourth projection angle having said vertical head shape category with said 6-inch guide length, and said eighth fall angle ranging from 60 degrees to 70 degrees;

a one hundred sixty-fifth projection angle of 60 degrees, said one hundred sixty-fifth projection angle having said vertical head shape category with said 2-inch guide length, and said ninth fall angle ranging from 45 degrees to 55 degrees;

a one hundred sixty-sixth projection angle of 65 degrees, said one hundred sixty-sixth projection angle having said vertical head shape category with said 3-inch guide length, and said ninth fall angle ranging from 45 degrees to 55 degrees;

a one hundred sixty-seventh projection angle of 70 degrees, said one hundred sixty-seventh projection angle having said vertical head shape category with said 4-inch guide length, and said ninth fall angle ranging from 45 degrees to 55 degrees;

a one hundred sixty-eighth projection angle of 70 degrees, said one hundred sixty-eighth projection angle having said vertical head shape category with said 5-inch guide length, and said ninth fall angle ranging from 45 degrees to 55 degrees;

a one hundred sixty-ninth projection angle of 70 degrees, said one hundred sixty-ninth projection angle having said vertical head shape category with said 6-inch guide length, and said ninth fall angle ranging from 45 degrees to 55 degrees;

a one hundred seventieth projection angle of 50 degrees, said one hundred seventieth projection angle having said vertical head shape category with said 2-inch guide length, and said tenth fall angle ranging from 30 degrees to 40 degrees;

a one hundred seventy-first projection angle of 55 degrees, said one hundred seventy-first projection angle having said vertical head shape category with said 3-inch guide length, and said tenth fall angle ranging from 30 degrees to 40 degrees;

a one hundred seventy-second projection angle of 60 degrees, said one hundred seventy-second projection angle having said vertical head shape category with said 4-inch guide length, and said tenth fall angle ranging from 30 degrees to 40 degrees;

a one hundred seventy-third projection angle of 60 degrees, said one hundred seventy-third projection angle having said vertical head shape category with said 5-inch guide length, and said tenth fall angle ranging from 30 degrees to 40 degrees; and a one hundred seventy-fourth projection angle of 60 degrees, said one hundred seventy-fourth projection angle having said vertical head shape category with said 6-inch guide length, and said tenth fall angle ranging from 30 degrees to 40 degrees.

* * * * *